US006634633B1

(12) United States Patent
Maruchi

(10) Patent No.: US 6,634,633 B1
(45) Date of Patent: Oct. 21, 2003

(54) BINDING MEMBER REMOVING APPARATUS, AUTOMATIC DOCUMENT FEEDER, SHEET PROCESSING APPARATUS, AND IMAGE FORMING APPARATUS

(75) Inventor: Noritoshi Maruchi, Toyokawa (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/377,011

(22) Filed: Aug. 18, 1999

(30) Foreign Application Priority Data

| | | |
|---|---|---|
| Aug. 25, 1998 | (JP) | 10-239053 |
| Sep. 28, 1998 | (JP) | 10-273839 |
| Sep. 28, 1998 | (JP) | 10-273840 |
| Sep. 29, 1998 | (JP) | 10-275594 |

(51) Int. Cl.[7] ..... B25C 11/00

(52) U.S. Cl. ..... 270/58.33; 270/58.07; 254/28

(58) Field of Search ..... 270/58.07, 58.08, 270/58.33; 399/377, 1; 227/63; 254/28

(56) References Cited

U.S. PATENT DOCUMENTS

| | | | | |
|---|---|---|---|---|
| 4,473,220 A | * | 9/1984 | Hovens et al. | 270/58.08 |
| 5,583,628 A | * | 12/1996 | Parks | 399/377 |

FOREIGN PATENT DOCUMENTS

| | | | |
|---|---|---|---|
| JP | 62-154445 | | 9/1987 |
| JP | 06-186807 | | 8/1994 |
| JP | 06343891 A | * | 12/1994 |
| JP | 08-015927 | | 1/1996 |
| JP | 08-090452 | | 4/1996 |
| JP | 08155857 | * | 6/1996 |
| JP | 08155858 | * | 6/1996 |
| JP | 08-208111 | | 8/1996 |

* cited by examiner

*Primary Examiner*—Patrick Mackey
(74) *Attorney, Agent, or Firm*—Sidley Austin Brown & Wood LLP

(57) ABSTRACT

A binding member removing apparatus 300 comprises a tray 30 for mounting thereon a bundle D of document sheets bound with a staple S, a removing unit 410 for removing the staple S from the bundle D of document sheets mounted on the tray 30, and a moving unit for moving the staple S removed by the removing unit 410. The removing unit 410 is provided with an inserting member 411 to be passed between the bundle of document sheets and the binding member binding the bundle of document sheets and the inserting member 411 is provided with a plurality of elongated parts 412 formed in the shape of a comb having teeth extended in the direction of insertion thereof. The inserting member optionally comprises a first inserting member 811 to be passed between the obverse face of the bundle D of document sheets and the staple S and a second inserting member 812 to be passed between the reverse face of the bundle D of document sheets and the staple S as a binding member. The binding member removing device is further provided with discerning means for forming a judgment whether or not the staple S has been removed from the bundle D of document sheets after the operation for removal of the staple S by the removing unit 410.

19 Claims, 19 Drawing Sheets

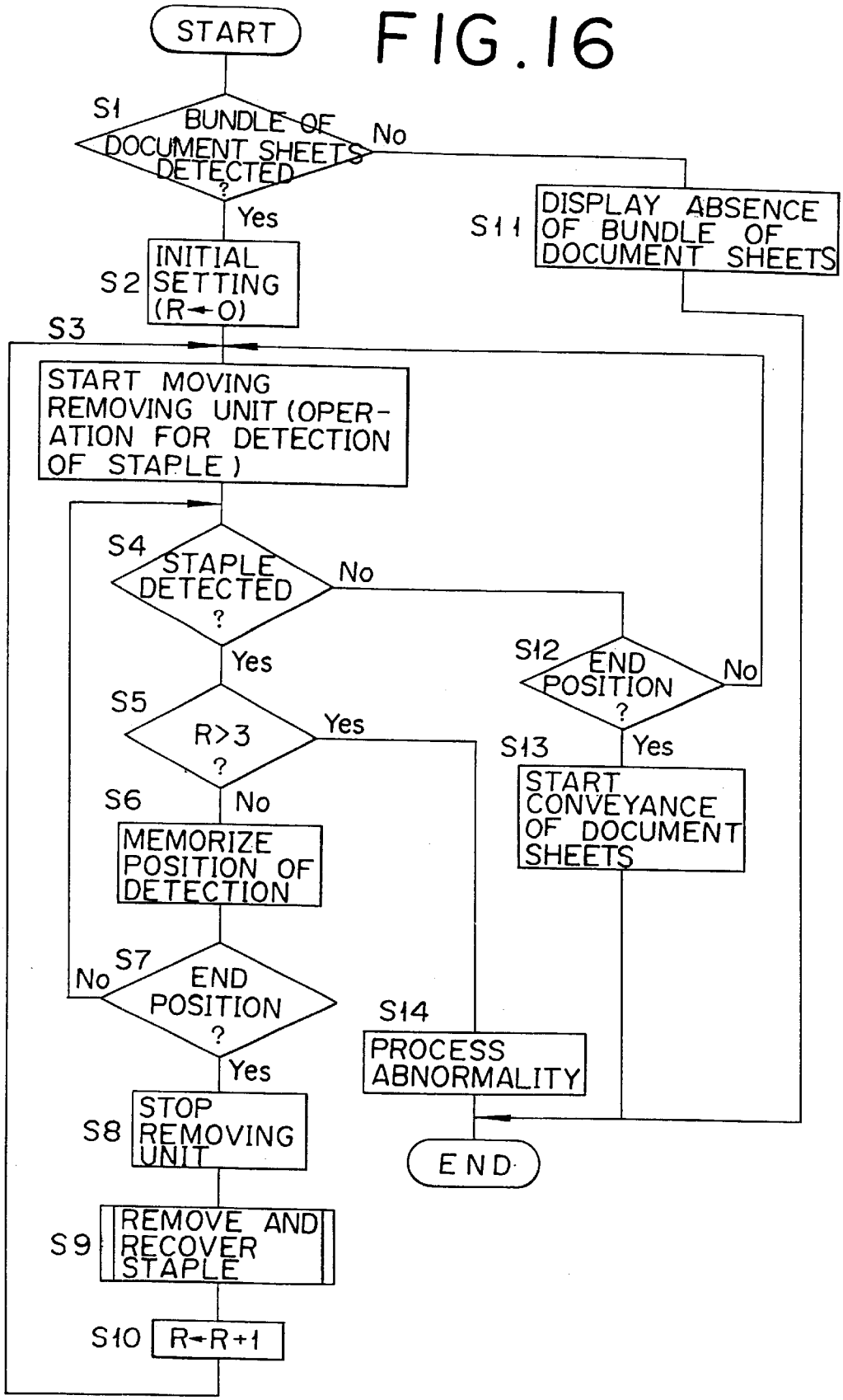
FIG. 16
START
S1
BUNDLE OF DOCUMENT SHEETS DETECTED ?
No
Yes
S11
DISPLAY ABSENCE OF BUNDLE OF DOCUMENT SHEETS
S2
INITIAL SETTING (R←0)
S3
START MOVING REMOVING UNIT (OPERATION FOR DETECTION OF STAPLE)
S4
STAPLE DETECTED ?
No
Yes
S12
END POSITION ?
No
Yes
S5
R>3 ?
Yes
No
S13
START CONVEYANCE OF DOCUMENT SHEETS
S6
MEMORIZE POSITION OF DETECTION
S7
END POSITION ?
No
Yes
S14
PROCESS ABNORMALITY
S8
STOP REMOVING UNIT
END
S9
REMOVE AND RECOVER STAPLE
S10
R←R+1

BINDING MEMBER REMOVING APPARATUS, AUTOMATIC DOCUMENT FEEDER, SHEET PROCESSING APPARATUS, AND IMAGE FORMING APPARATUS

This application is based on application Nos. 10-239053, 10-273839, 10-273840 and 10-275594 filed in Japan, the contents of which are hereby incorporated by reference.

BACKGROUND OF THE INVENTION

1. Field of the Invention

This invention relates to a binding member removing apparatus for removing a binding member such as a staple from a bundle of sheets of paper, and an automatic document feeder, a sheet processing apparatus, and an image forming apparatus which are provided with the binding member removing apparatus.

2. Description of the Related Art

Binding members such as clips, tapes, and staples of wire material furnished with opposite pointed ends are widely used for producing a book or a leaflet by binding collectively a bundle of a plurality of sheets of paper. In the case of binding a bundle of sheets of paper with staples, the opposite end parts of each staple folded in the shape of three sides of a square are driven through the bundle of sheets of paper and they are then folded inward toward each other. The staples used in this case generally have their size vary according to the number of sheets of paper forming a bundle.

A binding member removing apparatus is used for the purpose of removing the stapes from the bundle of sheets of paper which has been bound with the staples. The binding member removing devices of this class are classified on account of the difference in the action of removing a staple into two types, i.e. the type for removing a staple by cutting off part of the bundle of sheets of paper containing the staple (JP-A-08-15,927, JP-A-06-186,807 etc. refer) and the type for removing a staple by forcing an inserting member between the bundle of sheets of paper and the staple and extracting the staple with the inserting member (JP-U-62-154,445 refers).

The binding member removing apparatus which is disclosed in JP-A-06-186,807 is adapted to cut out the bound part of the bundle of the document sheets together with the sheets of paper forming the document by causing the cutting force of a punching blade to act on the document sheets approximating closely to the staple. The binding member removing apparatus which is disclosed in JP-A-08-15,927 is adapted to cut the part of the bundle of document sheets bound with a staple in the shape of a ribbon along one edge of the bundle of document sheets including the part mentioned above.

The pull-out type binding member removing apparatus which is disclosed in JP-U-62-154,445 has the inserting member disposed on that of the opposite surfaces of the bundle of sheets of paper in which the opposite end parts of a staple are not positioned. This binding member removing apparatus pulls a staple out of a bundle of sheets of paper by passing one inserting member between the bundle of sheets of paper and the staple and jerking the inserting member in the direction of expelling the staple. It, therefore, is incapable of cutting and removing part of the bundle of sheets of paper. Here, the staple is pulled out of the bundle of sheets of paper downward, made to fall down the path of recovery under the weight of its own, and recovered in a receptacle.

The binding member removing apparatus which are disclosed in the official gazettes mentioned above are invariably provided each for an automatic document feeder (ADF). When the bundle of document sheets in a state bound with a staple is mounted on the ADF provided with the binding member removing apparatus, the staple is automatically removed and then the document sheets are conveyed one by one from the bundle of document sheets which have been set loose in consequence of the removal of the staple. The copying machine is then set copying document sheets.

The conventional binding member removing apparatus mentioned above, however, have various problems as follows.

Firstly, the binding member removing apparatus so adapted that the removed staple will fall down under its own weight requires the path of recovery to be positioned substantially directly below a removing unit which serves the purpose of removing the staple and, at the same time, requires this path to approximate as closely to perpendicularity as permissible. For the purpose of securing the path of recovery of this description,therefore, the removing unit is inevitably destined to suffer the freedom of disposition thereof to be restricted. Particularly, the ADF which is provided with the binding member removing apparatus is not capable of adopting a structure allowing the staple to be removed upward from a bundle of sheets of paper mounted on the ADF because the removing unit is required to assume its position beneath the staple and cause the staple to be extracted from the lower side of the bundle by all means. This requirement poses a problem to the ADF of the type which particularly requires the document sheets to be mounted with the image face thereof held upward. Generally, the bundle of document sheets which is bound as a bundle of sheets of paper has a staple driven therein from the image face side thereof. If the ADF is provided with the removing unit which is adapted to extract the staple from the lower side of the bundle, the effect of automating the ADF will be inevitably impaired because the bundle of document sheets requiring removal of the staple must be mounted temporarily as held downward, i.e. in the direction opposite the direction in which the bundle is mounted for the purpose of conveyance by the ADF and,.after the subsequent extraction of the staple, the bundle must be reversed so as to turn the image faces of the document sheets upward.

Then, the ADF provided with the binding member removing apparatus of the type causing the removed staple to fall down under its own weight suffers the lower side of the ADF to be enlarged markedly because it requires a space for installing the path of recovery and the receptacle of recovery below the ADF. The ADF is generally disposed on the platen glass of a copying machine. For the purpose of allowing a large space to be provided below the ADF, therefore, it becomes necessary to devise a way of avoiding the occurrence of a large gap between the platen glass surface of the copying machine and the lower face of the ADF. As a result, the problems of readapting the construction of the ADF itself and altering the construction of the copying machine etc. ensue.

Secondly, the extraction type binding member removing apparatus must be provided with an inserting member which fits the staple. If the inserting member which does not fit the staple is forcibly used, the problem of not only rendering removal of a staple difficult but also possibly damaging the bundle of sheets of paper ensue.

This problem occurs not merely on the apparatus which effects removal of the binding member automatically but likewise on the manual binding member removing apparatus which effects removal of the binding member manually.

That is, the manual binding operation necessitates preparation of as many removing apparatus as kinds of size of staple. As a result, it suffers an increase in cost.

Further, this problem occurs on the ADF which is provided with the binding member removing apparatus. To be specific, the apparatus which effects removal of the binding member automatically suffers an increase not only in cost but also in size of the apparatus itself because it requires a plurality of inserting members to be accommodated in the interior of the apparatus.

The binding member removing apparatus of the type which pulls a staple out of a bundle of sheets of paper by passing one inserting member between the bundle of sheets of paper and the staple and jerking the inserting member in the direction of expelling the staple has the problem of tending to inflict damage on the bundle of sheets of paper unless the inserting member is passed infallibly between the bundle of sheets of paper and the staple binding this bundle and then moved smoothly.

Thirdly, the conventional apparatus mentioned above have no consideration for the question as to what measure is to be taken when the apparatus fails to remove the binding member. It is thought that the ADF which is provided with the binding member removing apparatus produces no problem of any sort so long as the staple has been normally removed. If the ADF fails to remove the binding member, it will proceed to effect the action of conveying the bundle of sheets of paper notwithstanding the bundle is still kept bound with the staple. As a result, the sheets of paper in the process of conveyance bring such problems as blocking the path of conveyance, sustaining breakage, and inflicting damage to the ADF.

The ADF is generally provided for a copying machine or a scanner. If the staple which has escaped removal is left advancing onto the platen glass of the copying machine or the scanner, it will have the possibility of inflicting damage to the surface of the platen glass.

Fourthly, the binding member removing apparatus of the extraction type is so constructed that the staple having folded opposite end parts is extracted from one face side of the bundle of sheets of paper. It, therefore, requires the force to be used for erecting or raising the opposite end parts of the staple in addition to the force for simply giving a pull at the staple. In short, to be used for extracting the staple from the bundle of sheets of paper, the force must be relatively large. The drive mechanism which is provided with a motor or a gear train which is adapted to actuate the inserting member, therefore, suffers an increase in size and, by the same token, the binding member removing apparatus suffers an addition to the size thereof.

Further, the extraction type binding member removing apparatus has the possibility that when the staple having the opposite leading-end parts thereof driven through the bundle of sheets of paper and then folded toward each other is extracted from one face side of the bundle of sheets of paper, the folded opposite leading end parts will inflict damage to the individual sheets of paper forming the bundle.

SUMMARY OF THE INVENTION

An object of this invention is to provide a binding member removing apparatus which is endowed with a staple recovering facility capable of easing the restriction on the freedom of disposition of the means for removing the binding member from the bundle of sheets of paper and particularly ensuring the recovery of the staple even when the removing means is so disposed as to enable the binding member to be removed from the upper side of the bundle of sheets of paper, and an automatic document feeder, a sheet processing apparatus, and an image forming apparatus which are provided with this binding member removing apparatus.

One aspect of this invention consists in a binding member removing apparatus which comprises a tray for mounting thereon a bundle of sheets of paper bound with a binding member, a removing unit for removing said binding member from said bundle of sheets of paper mounted on said tray, and a moving unit for moving said binding member removed in said removing unit, and an automatic document feeder, a sheet processing apparatus, and an image forming apparatus which are provided with the binding member removing apparatus.

Since this aspect of the invention enables the binding member removed from the bundle of sheets of paper to be forcibly moved by the moving unit, it heightens the freedom of disposition of the removing unit or the moving unit and, even when the binding member is extracted and removed from the upper side of the bundle, for example, enables the moving unit to attain infallible removal of the binding member from the neighborhood of the bundle of sheets of paper.

Another object of this invention is to provide a binding member removing apparatus which is capable of easily and infallibly removing the binding member from the bundle of sheets of paper by the use of one inserting member without inflicting damage on the bundle of sheets of paper, and an automatic document feeder, a sheet processing apparatus, and an image forming apparatus which are provided with the binding member removing apparatus.

One aspect of this invention consists in a binding member removing apparatus which comprises an inserting member to be passed between a bundle of sheets of paper and a binding member for binding said bundle of sheets of paper, said inserting member being provided with a plurality of elongated parts formed in the shape of a comb having teeth elongated in the direction of insertion of said inserting member, and an automatic document feeder, a sheet processing apparatus, and an image forming apparatus which are provided with the binding member removing apparatus.

This aspect of the invention enables one inserting member to effect removal of a binding member of a varying size by causing a fixed number of elongated parts to be passed between the bundle of sheets of paper and the binding member and held fast therein. This removal of the binding member can be attained infallibly and easily even when the position of the inserting member relative to the binding member is deviated more or less.

Yet another object of this invention is to provide a binding member removing apparatus which, during the removal of the binding member from the bundle of sheets of paper, performs a proper measure even when the removal of the binding member ends in failure and which, particularly in the automatic document feeder provided with the binding member removing apparatus, performs the proper measure without entailing such disadvantages as inflicting damage to the bundle of sheets of paper and blocking the path of conveyance even when the removal of the binding member ends in failure, and an automatic document feeder, a sheet processing apparatus, and an image forming apparatus which are provided with the binding member removing apparatus.

One aspect of this invention consists in a binding member removing apparatus which comprises a removing unit for removing a binding member from a bundle of sheets of paper and discriminating means for determining whether or not said binding member has been removed from said bundle of sheets of paper after the operation for removal of said binding member by said removing unit, and an automatic document feeder, a sheet processing apparatus, and an image forming apparatus which are provided with the binding member removing apparatus. This aspect of the invention, even when the removing unit has failed to remove the binding member from the bundle of sheets of paper, is capable of detecting this failure. It is, therefore, capable of preventing the operation of conveyance from proceeding while the binding member remains fast on the bundle of document sheets as by actuating the removing unit once again to effect perfect removal of the binding member or stopping the conveyance of document sheets, for example.

Still another object of this invention is to provide a binding member removing apparatus which is capable of extracting the binding member with relatively small force and, at the same time, preventing the sheets of paper from sustaining breakage while the binding member of the shape of a needle provided with opposite pointed ends is extracted therethrough, and an automatic document feeder, a sheet processing apparatus, and an image forming apparatus which are provided with the binding member removing apparatus.

One aspect of this invention consists in a binding member removing apparatus for removing a binding member from a bundle of sheets of paper which comprises an inserting member to be passed between said bundle of sheets of paper and said binding member binding said bundle of sheets of paper, said inserting member comprising a first inserting member to be passed between a first face of said bundle of sheets of paper and said binding material and a second inserting member to be passed between a second face of said bundle of sheets of paper and said binding member, and an automatic document feeder, a sheet processing apparatus, and an image forming apparatus which are provided with the binding member removing apparatus. This aspect of the invention, therefore, enables the binding member to be extracted with relatively small force.

The objects, features, and characteristics of this invention other than those set forth above will become apparent from the description given herein below with reference to preferred embodiments illustrated in the accompanying drawings.

BRIEF DESCRIPTION OF THE DRAWINGS

FIG. 16 is a main flow chart illustrating the procedure of the operation of the binding member removing apparatus.

DETAILED DESCRIPTION OF THE PREFERRED EMBODIMENT

The embodiments of this invention will be described below with reference to the accompanying drawings.

FIRST EXAMPLE

The first example is a copying machine which is provided with an automatic document feeder incorporating therein the binding member removing apparatus according to this invention.

<<Copying Machine>>

First, the general construction of the copying machine and the operation thereof will be described.

Figure 1:
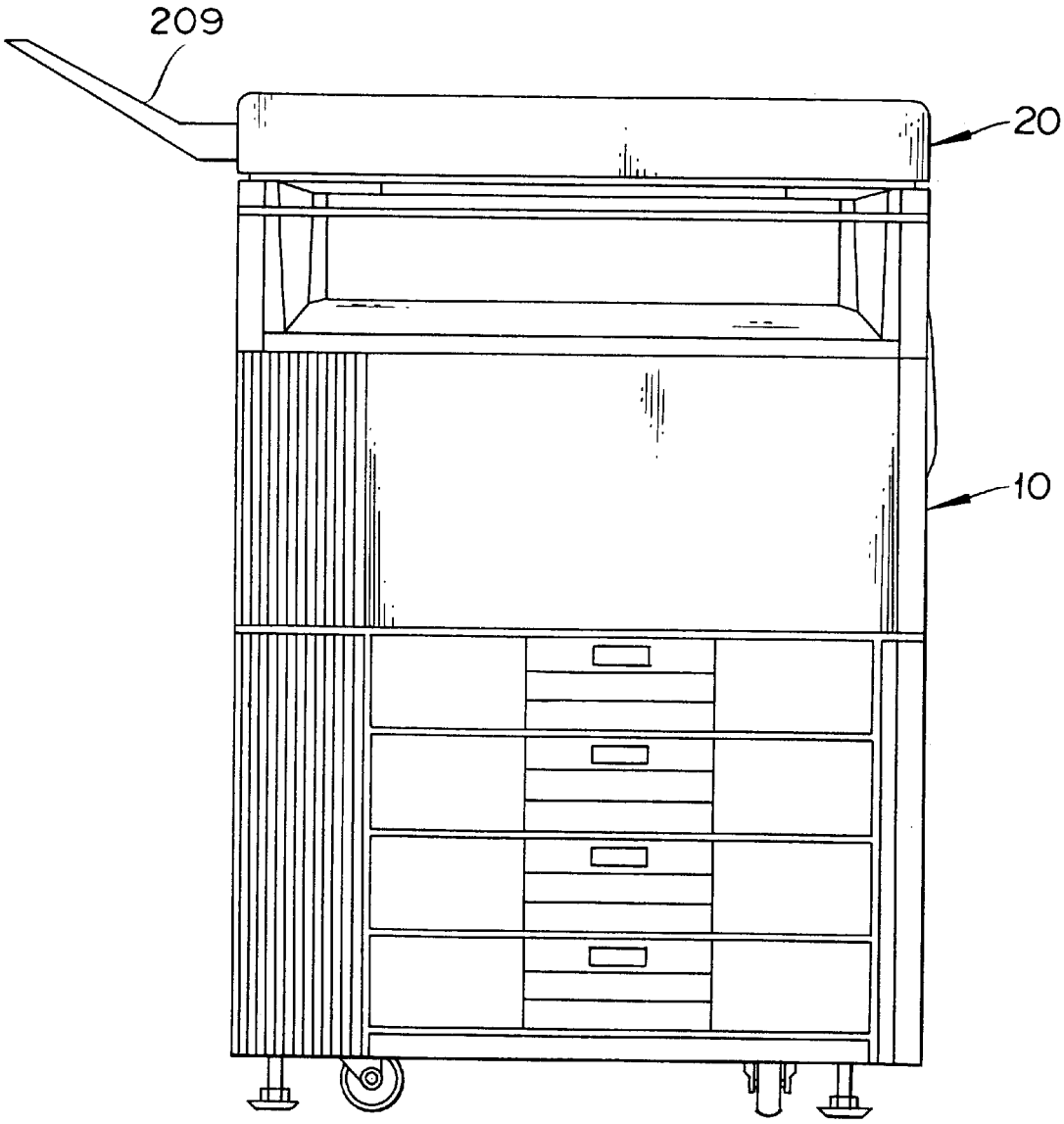
FIG. 1 is a side view of a copying machine provided with an automatic document feeder.

FIG. 1 is a side view of the copying machine provided with the automatic document feeder.

The copying machine illustrated in FIG. 1 is provided on a main body of the copying machine with an automatic document feeder (ADF) 20. The ADF 20 picks document sheets one by one from a bundle of document sheets mounted thereon and conveys them onto a platen glass in the upper part of the copying machine proper 10. The copying machine proper 10 is the so-called digital copying machine operating by a procedure which comprises causing an image reader (not shown) in the copying machine proper to read the document sheets conveyed by the ADF 20, storing the read image temporarily in a memory, optionally subjecting the image to various forms of edition, and producing an image on a sheet of paper by the electrophotographic process well known in the art. The description of this copying machine will be omitted here.

<<Automatic Document Feeder>>

Figure 2:
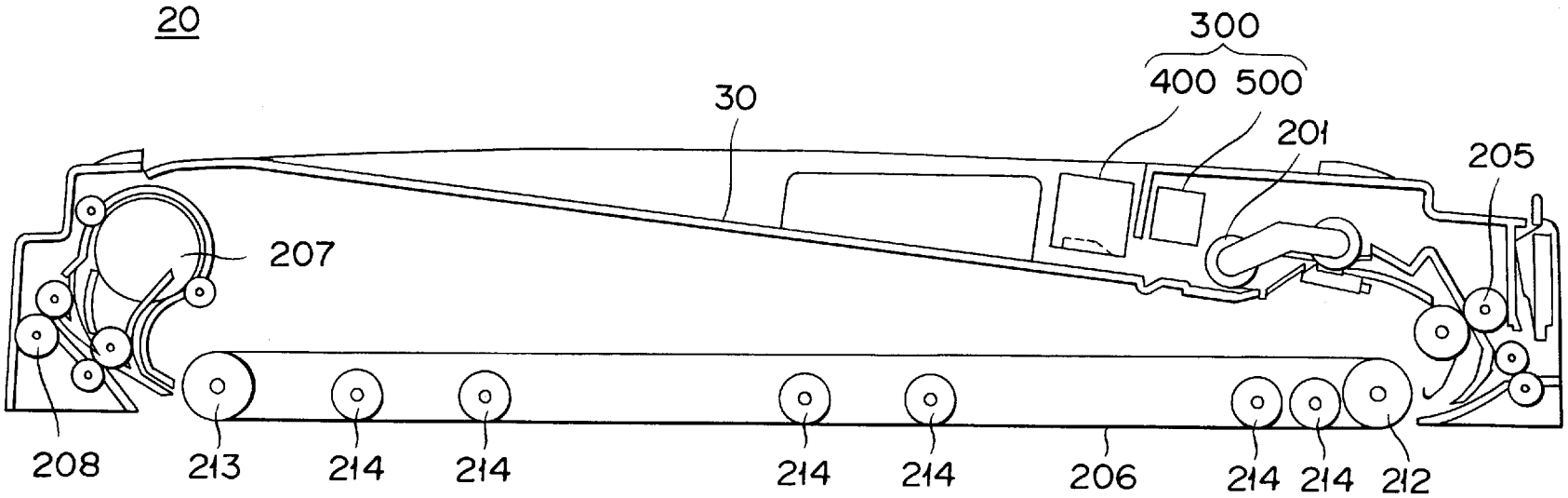
FIG. 2 is a schematic structural diagram illustrating the internal construction of the automatic document feeder.

FIG. 2 is a schematic structural diagram illustrating the internal construction of the automaticdocument feeder (ADF).

The ADF 20, as illustrated in FIG. 2, is provided with a tray 30 for mounting a bundle of document sheets as a bundle of sheets of paper, a separating roller 201 for drawing document sheets one by one from the bundle, a resist roller pair 205 and a conveying belt 206 for conveying the separated document sheets, an inverting roller 207 for inverting the obverse-reverse face of the document sheet, and a discharge roller pair 208 for discharging the document sheet. The document sheet which has departed from the discharge roller pair 208 is discharged into a discharged paper tray 209 (FIG. 1 refers). The conveying belt 206 is stretched in an endless state between a driving roller 212 and a following roller 213 so as to cover the entire surface of the platen glass of the copying machine proper. Inside the conveying belt 206, a multiplicity of backup rollers 214 are rotatably disposed so as to press the conveying belt 206 against the platen glass.

The ADF 20 is provided with a binding member removing apparatus 300 for removing a staple from a bundle of document sheets while the bundle of document sheets bound with the staple is mounted on the tray 30. This binding member removing apparatus 300 is provided with a removing device 400 for removing a staple as a binding member from the bundle of document sheets and a recovering device 500 for taking the removed staple away from the proximity of the bundle of document sheets. The binding member removing apparatus 300 is disposed near the document set surface of the tray 30 for mounting the bundle of document sheets, for example, near the leading end part of the downstream side of the direction of conveyance of document sheets. The whole ADF, therefore, can be constructed compactly and maintained easily without obstructing the layout such as of the mechanism for the conveyance of document sheets.

<<Removing Device>>

Figure 3:
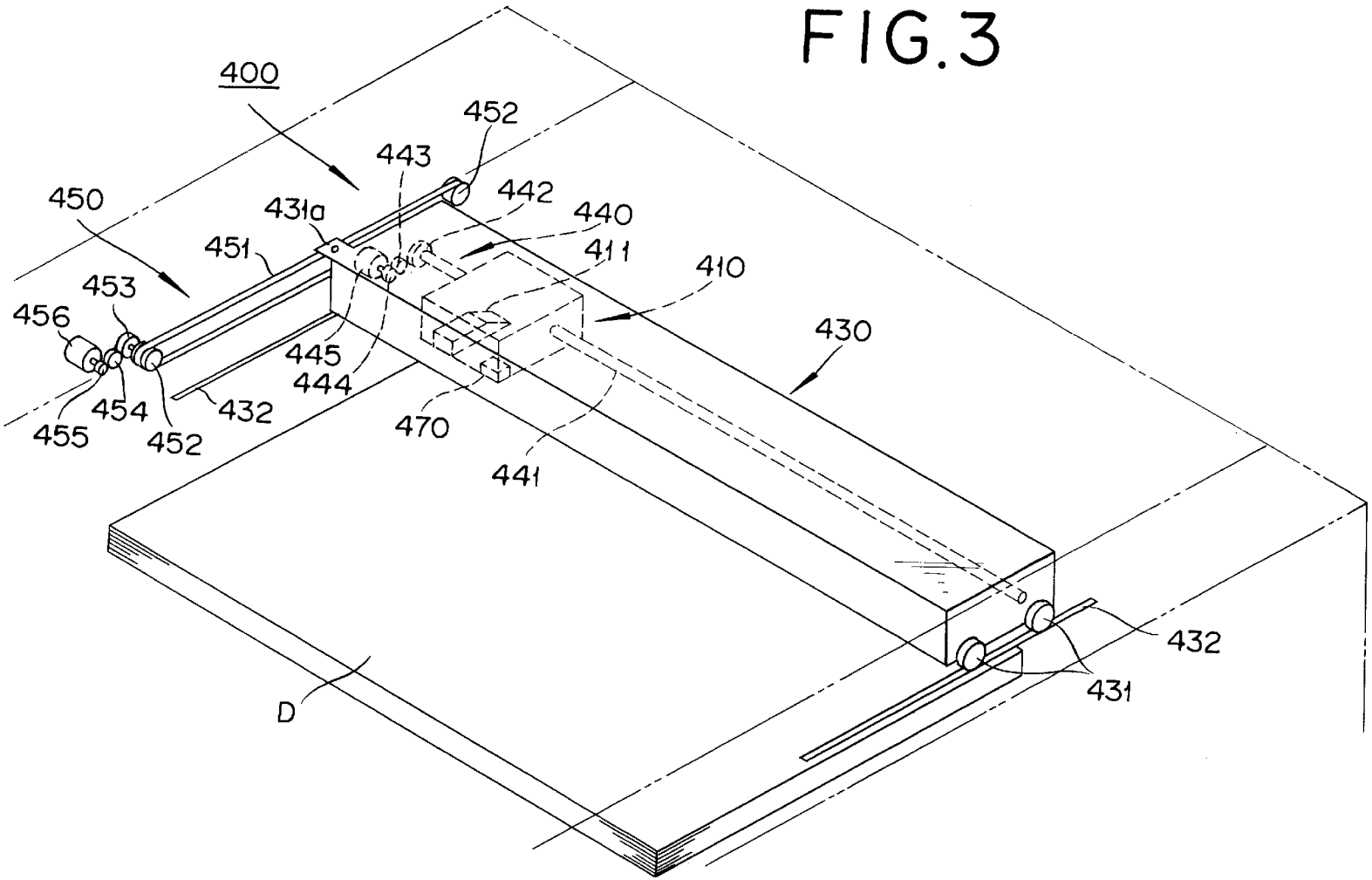
FIG. 3 is a perspective view schematically illustrating a removing device in the binding member removing apparatus.
Figure 4A:
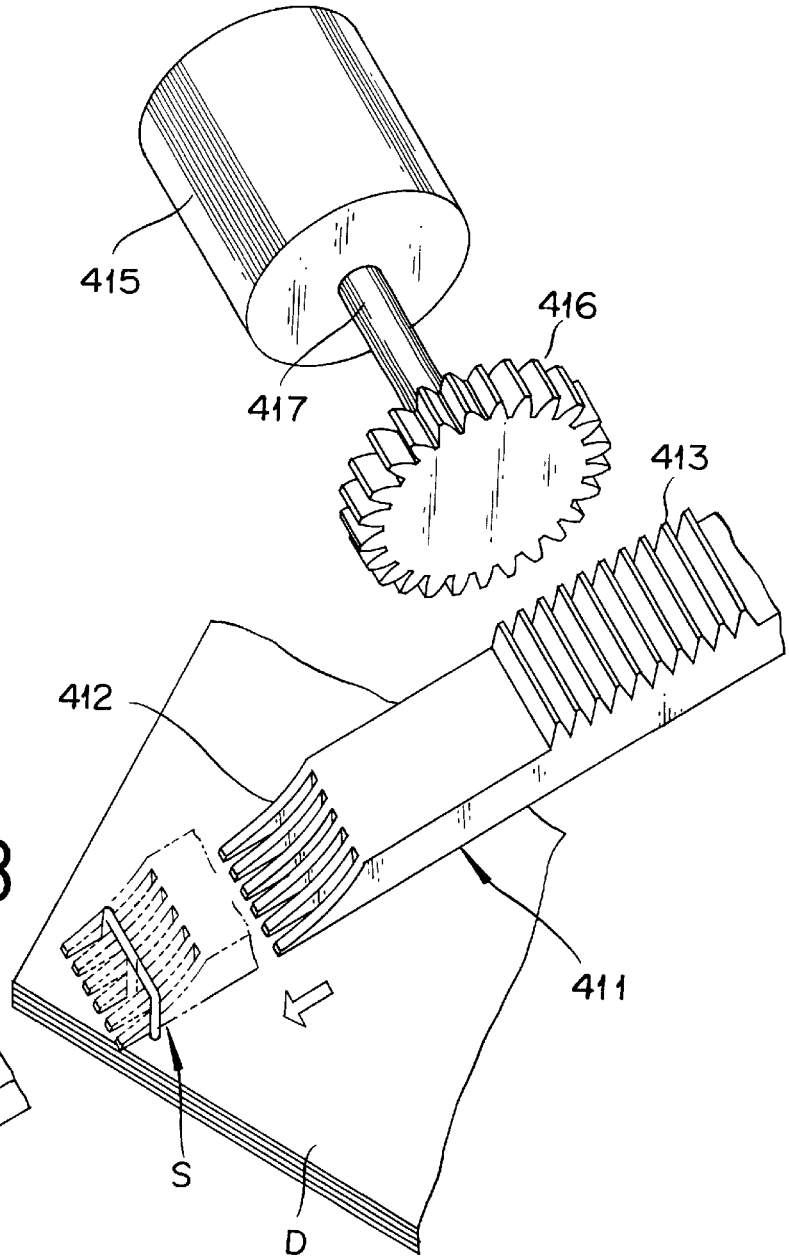
FIG. 4A is a perspective view of the removing device prior to removal of a staple, intended to aid in the description of the removal of the staple.
Figure 4B:
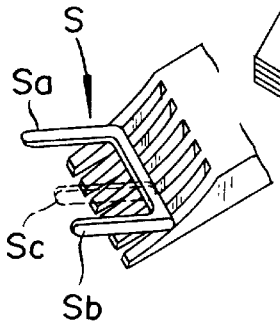
FIG. 4B is the perspective view subsequent-to the removal.

FIG. 3 is a perspective view schematically illustrating the construction of the removing device provided in the binding member removing apparatus, FIG. 4A is a perspective view of the removing device prior to removal of a staple, intended to aid in the description of the removal of the staple, and FIG. 4B is the perspective view of the removing device subsequent to the removal.

The removing device 400, as illustrated in FIG. 3, is provided with a removing unit 410 fitted with an inserting member 411 intended to be passed between the bundle of document sheets and the staple for binding this bundle, a supporting member 430 for slidably supporting the removing unit 410 therein, a removing unit moving mechanism 440 for moving the removing unit 410 in the direction perpendicular to the direction of conveyance of document sheets, namely in the direction of width of document sheets, inside the supporting member, and a supporting member moving mechanism 450 for moving the whole supporting member 430 in the direction of conveyance of document sheets.

The removing unit 410, as illustrated in FIG. 4, comprises the inserting member 411 mentioned above and a drive mechanism for moving the inserting member 411 in the direction of the interface between the bundle D of document sheets and the staple S binding the bundle of document sheets. From the viewpoint of compaction, the drive mechanism embraces an electric actuator such as, for example, an electric motor 415.

On the leading end side of the inserting member 411 of the removing unit 410, a plurality of elongated parts 412 are extended in the direction of insertion after the fashion of the teeth of a comb. These elongated parts 412 are formed in such a sloped shape that their thicknesses in the direction of thickness of the bundle of document sheets decrease toward the leading ends thereof. The sloped shape of the elongated parts 412 is preferred to be such that the lower faces of the elongated parts form a flat surface and the upper faces thereof form a concavely arcuate surface as illustrated. Consequently, it is made possible to pass the inserting member 411 more perfectly between the bundle D of document sheets and the staple S and move the staple S more smoothly. The sloped faces of the elongated parts 412, when necessary, may form a slanted flat surface.

The inserting member 411 may be made of an aluminum alloy, for example. The inserting member 411 does not need to be limited to this particular material. It may be otherwise made of resinous materials and ceramic materials besides various metallic materials. The surface of the inserting member 411, for the purpose of decreasing the frictional resistance thereof, may be coated with such an antifriction material as fluorine resin, for example.

Generally, the widths of the plurality of elongated parts 412 of the inserting member 411 and the intervals between the adjacent elongated parts 412 are set at about 1 mm, for example. They may be optionally altered suitably. The material for and the widths of the elongated parts 412 are preferred to be so selected that the produced elongated parts 412 may possess not only stated strength but also proper elasticity. In consequence of this selection, the elongated parts 412, on approaching leg parts Sa, Sb of the staple S during the process of passage of the inserting member 411 between the bundle D of document sheets and the staple S, are enabled to avoid colliding with the leg parts Sa, Sb of the staple S by being conveniently deformed elastically.

The overall width of the inserting member 411 is decided, depending on the kind of size of the staple S to be used. In the case of both the staple of the largest size having the leg parts Sa and Sb as illustrated in FIG. 4B, for example, and the staple of the smallest size having the leg parts Sa and Sc (indicated by a broken line in the diagram), the overall width of the inserting member 411 is so set that the inserting member 411 will be passed perfectly between the bundle D of document sheets and the staple S.

On the trailing end side of the inserting member 411, a rack 413 is formed as illustrated in FIG. 4A. A pinion 416 is meshed with the rack 413. Incidentally, FIG. 4A depicts the rack 413 and the pinion 416 in a separated state.

This pinion 416 is fixed on a main shaft 417 of the electric motor 415 mentioned above. The inserting member 411, therefore, acquires such a simple and compact construction that the rotational drive of the electric motor 415 is converted into a forward-rearward motion of the inserting member 411 through the medium of the pinion 416 and the rack 413. The drive mechanism for moving the inserting member 411 does not need to be limited to what embraces the electric motor 415. It may be in a simple structure provided with a spring member, for example, and enabled to drive the inserting member 411 by utilizing the resilient force of the spring member. In this case, the spring member may be provided with means capable of controlling the spring member so as to release the resilient force gradually.

The removing unit 410, as illustrated in FIG. 3, is provided with a detecting device 470 capable of detecting the staple S for binding the bundle D of document sheets. This detecting device 470 is a magnetic sensor, for example, which detects the staple S made of a metal. By this detecting device 470, the presence or absence of the staple S or the position thereof can be discerned without contact from above the bundle D of document sheets. The detecting device 470 does not need to be limited to the magnetic sensor. It only requires to detect the staple S by optical image processing or by means of a contact pressure sensor instead.

The supporting member 430 is formed of an oblong box opened downward at a prescribed position and is adapted to accommodate the removing unit 410 therein. Near the lower end of the supporting member 430, four wheels 431 are rotatably attached. This supporting member 430 is made movable in the direction of conveyance of document sheets by having the wheels 431 disposed on a rail 432 laid on the main body side of the ADF 20.

The removing unit moving mechanism 440 is provided with a feed screw shaft 441 which is adapted to be meshed with a nut part (not shown) formed on the removing unit 410. A female screw is formed in the nut part of the removing unit 410. The removing unit 410 is so constructed as to be moved inside the supporting member 430 in the direction of width of document sheets by the rotation of the feed screw shaft 441. In order for the removing unit 410 to be smoothly moved inside the supporting member 430 in the direction of length thereof, a guide bar (not shown) is disposed parallelly to the feed screw shaft 441. On one end of the feed screw shaft 441, a gear 442 is fixed. An electric motor 445 is so constructed that the rotary driving force thereof may be transmitted from a gear 444 fixed on the main shaft of the motor to the feed screw shaft 441 through the medium of an idler gear 443 and a gear 442.

The supporting member moving mechanism 450 comprises a drive belt 451 to be fixed on a connecting part 431*a* which is connected to one end of the supporting member 430, pulleys 452, 452 for allowing the drive belt to be suspended as passed therearound, a gear 453 fixed on one end side of a shaft having one of the pulleys 452 fixed on the other end thereof, an idler gear 454 meshed with the gear 453, a drive gear 455 meshed with the idler gear 454, and an electric motor 456 having the main shaft thereof connected to the drive gear 455 and operated to impart rotational drive thereto. The supporting member 430, therefore, is enabled to be moved by a prescribed distance in the direction of conveyance of document sheets by causing the electric motor 456 to be rotated normally or reversely.

Example 1 of Modification of Removing Device

Figures 5A, 5B:
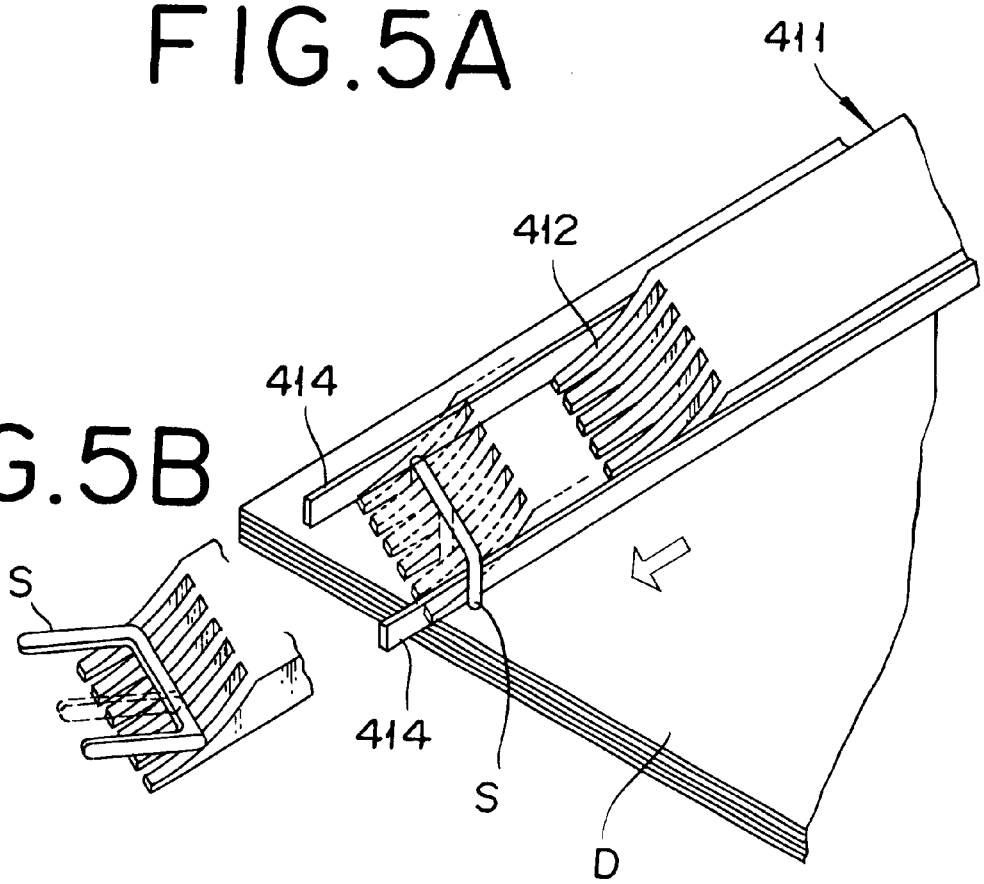
FIG. 5A is a perspective view of example 1 of modification of the removing device prior to removal of a staple, intended to aid in the description of the removal of the staple.
FIG. 5B is the perspective view subsequent to the removal.

FIG. 5A is a perspective view of example 1 of modification of the removing device prior to removal of a staple, intended to aid in the description of the removal of the staple, and FIG. 5B is the perspective view subsequent to the removal.

This removing device differs from the removing device described above in respect that it is additionally provided with guide members 414, 414 adapted to guide the forward-rearward motion of the inserting member 411. Since this removing device is identical in all the other respects with the removing device described above, like parts will be denoted by like reference numerals and their description will be omitted herein.

The guide members 414, 414 of this removing device are disposed as parallelly paired so as to contact the opposite lateral faces of the inserting member 411. Owing to this construction, the accuracy of the forward-rearward motion of the inserting member 411 is improved and the reliability of the removal of the staple is exalted.

Example 2 of Modification of the Removing Device

Figure 6A:
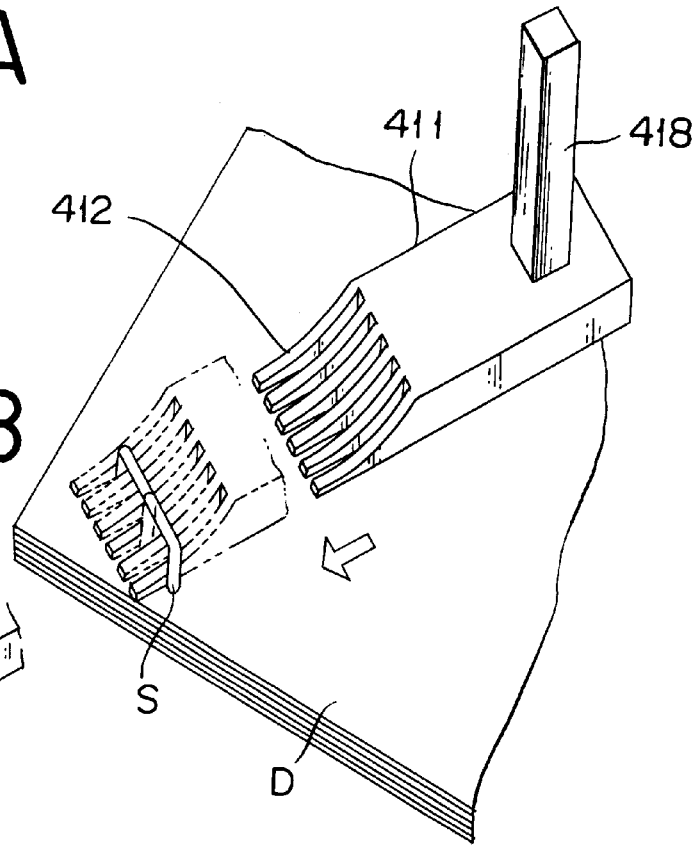
FIG. 6A is a perspective view of example 2 of modification of the removing device prior to removal of a staple, intended to aid in the description of the removal of the staple.
Figure 6B:
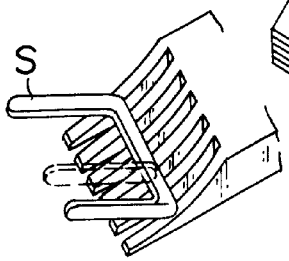
FIG. 6B is the perspective view subsequent to the removal.
Figure 7:
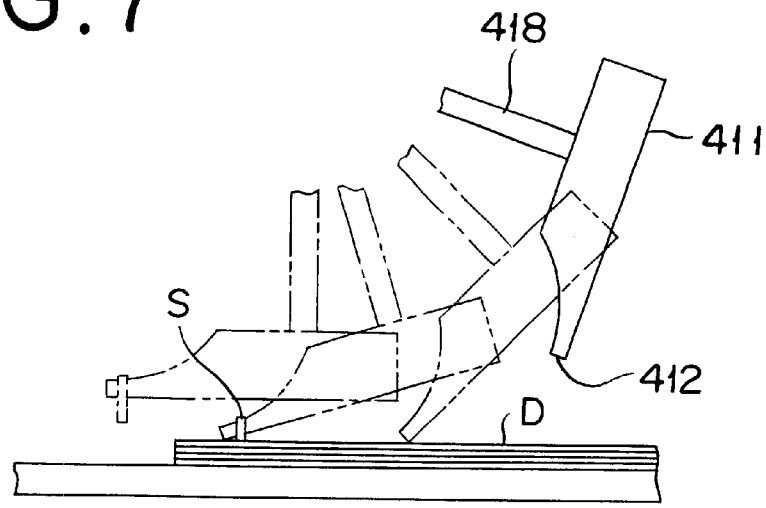
FIG. 7 is a diagram illustrating the operation of removing the staple shown in FIG. 6A and FIG. 6B as viewed laterally.

FIG. 6A is a perspective view of example 2 of modification of the removing device prior to removal of a staple, intended to aid in the description of the removal of the staple, and FIG. 6B is the perspective view subsequent to the removal. FIG. 7 is a diagram illustrating the operation of removing the staple shown in FIG. 6A and FIG. 6B as viewed laterally.

This removing device differs from the removing device shown in FIG. 4A and FIG. 4B in respect that it is additionally provided with an arm part 418 connected to the inserting member 411 and consequently enabled, by virtue of the oscillation of the arm part 418, to move the inserting part 411 in the direction of the interface between the bundle D of document sheets and the staple S. Since this removing device is identical in all the other respects with the removing device shown in FIG. 4A and FIG. 4B, like parts will be denoted by like reference numerals and their description will be omitted herein.

The arm part 418 of this removing device is so constructed as to be oscillated about-a-rotary shaft (not shown) disposed in the proximity of the upper end of the arm part 418, for example. The inserting member 411 connected to the lower end of the arm part 418 is enabled, as illustrated in FIG. 7, to be moved substantially horizontally in the proximity of the staple S expected to be removed. Incidentally, the arm part and the inserting member may be in an integrally formed structure. This removing device can manifest the same effect as the removing device shown in FIG. 4A and FIG. 4B. This removing device can promote simplification of structure because the inserting member 411 effects the removal of the staple without requiring the bundle D of document sheets to be lifted for the sake of alignment in the direction of height and, at the same time, produces a downward motion of itself in the direction of the bundle D of document sheets by virtue of the oscillation of the arm part 418. In this case, by forming the arm part 418 in an expandable structure as with a spring member, the removing device is enabled to absorb dispersion in the thickness of the bundle D of document sheets.

Example 3 of Modification of the Removing Device

Figure 8:
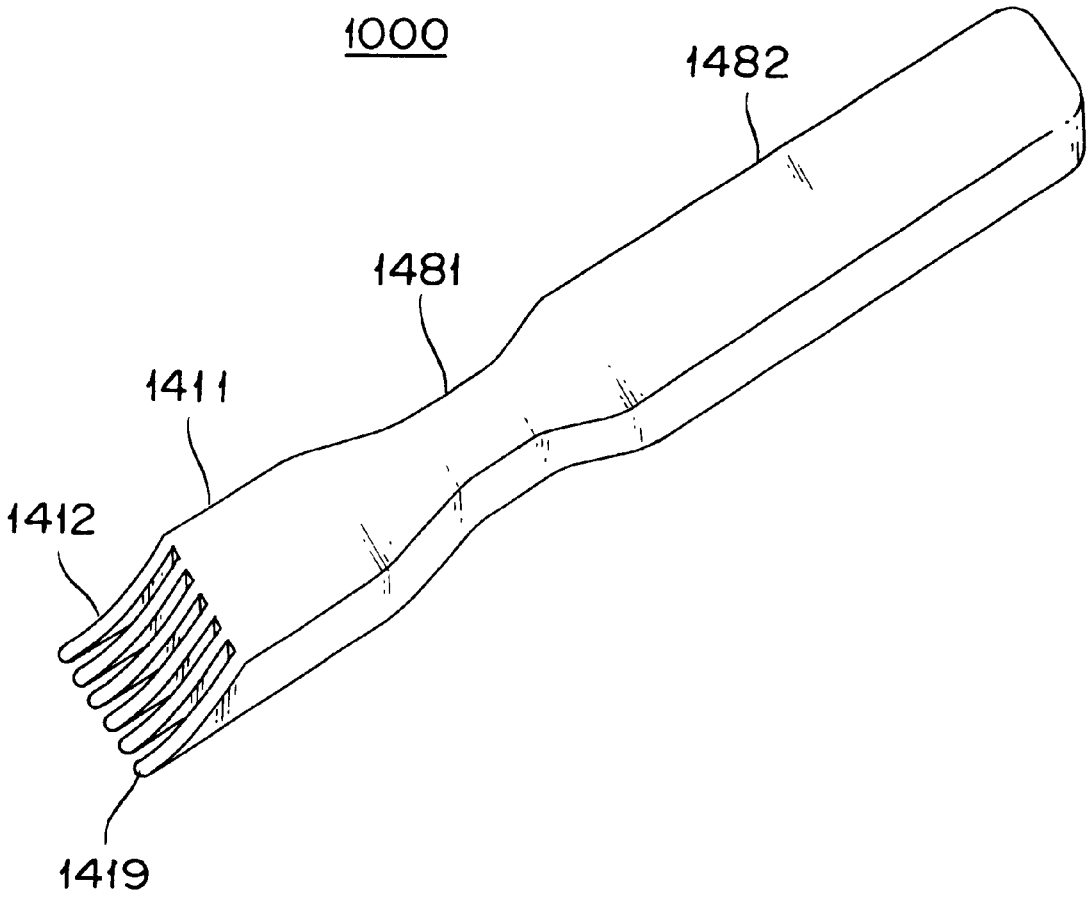
FIG. 8 is a perspective view schematically illustrating a manual binding member removing apparatus provided with example 3 of modification of the removing device.

FIG. 8 is a perspective view schematically illustrating a manual binding member removing apparatus provided with example 3 of modification of the removing device. This binding member removing apparatus 1000 is provided with a m finger grip part 1481 connected to an inserting member 1411 and a handle part 1482 connected to the finger grip part 1481. This binding member removing apparatus 1000 differs from the aforementioned binding member removing apparatus provided with the drive mechanism for driving the inserting member in respect that it is so constructed that the operator holds the device in his hand and directly removes the staple S from the bundle D of document sheets.

This binding member removing apparatus 1000 has the inserting member 1411 form a plurality of elongated parts 1412 after the fashion of teeth of a comb. Owing to this shape, the inserting member 1411 all by itself can handle staples of varying sizes because some of the individual elongated parts 1412 are passed beneath a given staple. The binding member removing apparatus 1000, therefore, obviates the necessity of preparing near at hand a plurality of inserting members 1411 which match staples of varying sizes and enables stapes of varying sizes to be removed easily and infallibly.

Further, since the elongated parts 1412 have their leading ends rounded, they enable the inserting member 1411 to be passed more easily between the opposed shank parts of a given staple. The leading ends of the elongated parts 1412, when necessary, may be chamfered instead of being rounded.

<<Recovering Device>>

The recovering device 500, as illustrated;in FIG. 2, is disposed inside the ADF 20 above the document sheets mounted thereon at the leading end of the document sheets on the downstream side in the direction of conveyance of document sheets. As a result, the lower side of the ADF cannot gain in size. Inside the recovering device 500, a moving unit for removing the staple removed by the removing unit from the upper face of the document sheets as described specifically herein below is disposed. The moving unit covers the whole width (perpendicular to the direction of conveyance) of document sheets.

Figure 9:
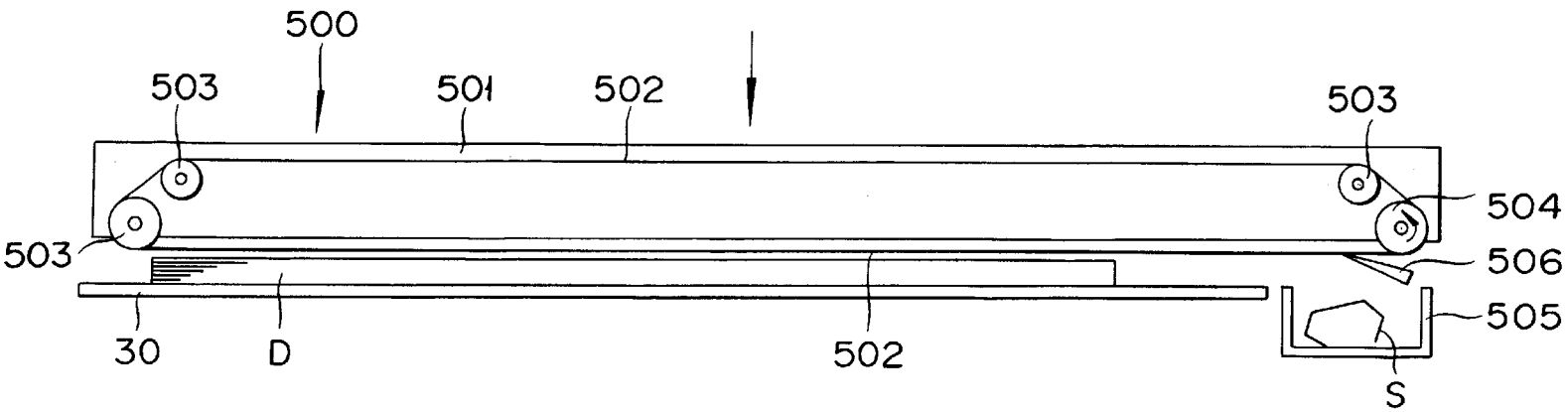
FIG. 9 is a schematic structural diagram illustrating a recovering device for the binding member removing apparatus.
Figure 10:
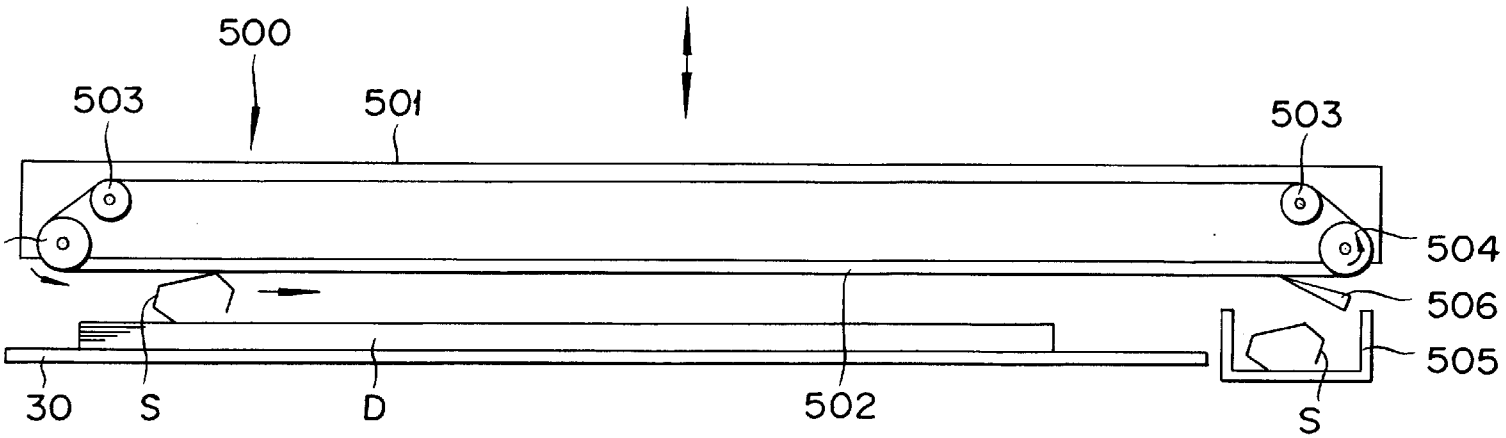
FIG. 10 is a diagram intended to aid in the description of the operation of the recovering device for the binding member removing apparatus.

FIG. 9 and FIG. 10 are schematic diagrams intended to aid in the description of the recovering device.

This recovering device 500 comprises a supporting case 501, a moving belt 502 for moving a removed staple, a rotatable supporting roller 503 fixed on the case 501 and adapted to support the moving belt 502, a driving roller 504 connected to a motor (not shown) and adapted to move the moving belt 502, a receiving box 505 for receiving the staple S brought in by the moving belt 502, and a blade 506 which is a separating member for removing the staple S from the moving belt 502 and dropping it into the receiving box 505.

Here, the moving belt 502 in itself is a magnetic body, which is obtained, for example, by coating the surface of a rubber belt with a magnetic substance. Then, this moving belt 502 is supported in an endless state as illustrated by the rollers 503 and 504 so as to cover the whole width of a document sheets. As a result, the staple S can be taken away the document sheets, no matter what position in the direction of width of the document sheets the staple may be extracted from the document sheets.

This recovering device 500 is provided with a driving mechanism (not shown) intended to move the device wholly in a vertical direction. As a result, the recovering device 500 is freely movable between a first position approximating closely to the tray 30 on which the lower face of the moving belt 502 nearly contacts the bundle D of document sheets as illustrated in FIG. 9 and a second position parted from the tray 30 for moving the staple S as illustrated in FIG. 10. The distance of motion to the second position is only required to be such that a slight gap enough to hold one staple may enter between the bundle D of document sheets and the moving belt 502. Incidentally, the moving belt 502 may be solely moved in a vertical direction instead of moving the recovering device wholly. It is also allowable to move only the side of the moving belt 502 facing the bundle D of document sheets in a vertical direction.

This recovering device 500 is held at the upper position (FIG. 10) while the staple S is being removed by the removing device 400 so as to avoid interfering with the extraction of the staple S. After the staple S has been extracted from the bundle D of document sheets, the recovering device 500 is wholly moved downward as illustrating in FIG. 9 so that the staple S extracted by the magnetic force of the moving belt 502 may adhere to the moving belt 502. After the recovering device 500 in the ensuant state is moved upward, the staple 3 is moved to the receiving box 505 by the rotation of the moving belt 502 in the direction indicated with an arrow mark in FIG. 10. After the staple S has been moved to a level above the receiving box 505, it is pulled away the moving belt 502 by the blade 506 and dropped into the receiving box 505 in consequence of further rotation of the moving belt 502.

This recovering device 500 is enabled to acquire a very simple structure by forming the moving belt 502 itself with a magnetic body as described above and consequently cause the removing device 400 to carry the staple S extracted from the bundle D of document sheets to the receiving box 505 and take it away the proximity of the bundle of document sheets.

Example 1 of Modification of the Recovering Device

Now, example 1 of modification of the recovering device will be described below. In the following examples of modification of the recovering device, the moving units provided therefor are varied in form. In the following description, members possessing a like function will be denoted by a like reference numeral and will be omitted from the description.

Figure 11:
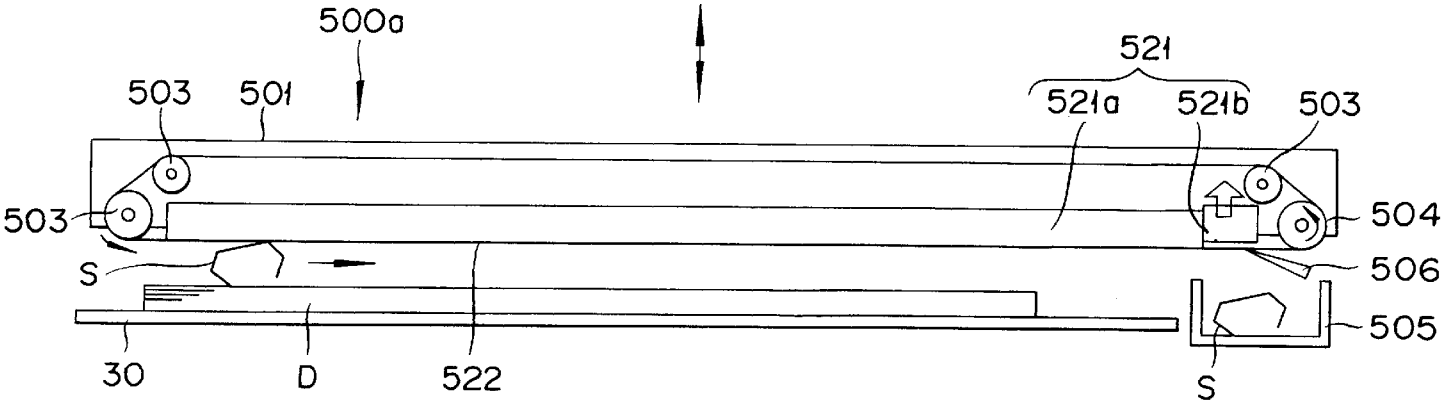
FIG. 11 is a schematic structural diagram illustrating example 1 of modification of the covering device for the binding member removing apparatus.

This recovering device 500*a*, as illustrated in FIG. 11, is identical in basic structure with the recovering device mentioned above. Specifically, a moving belt 522 is suspended in an endless state as passed around the supporting roller 503 and the driving roller 504 which are provided in the case 501 and the receiving box 505 and the blade 506 are disposed in the proximity of the end part on the right side in the bearings of the diagram.

The recovering device 500*a* differs from the recovering device mentioned above in respect that the moving belt itself is not a magnetic body and a permanent magnet 521 is disposed instead on the inner side of the moving belt 522.

The permanent magnet 521 in the moving belt comprises a stationary part 521*a* so large as to cover the whole width of document sheets and a movable part 521*b* adapted to move in a vertical direction.

The movable part 521*b* of the permanent magnet produces a motion synchronous with the rotation of the driving roller 504. Here, the movable part 521*b* is connected to the driving roller 504 through the medium of a gear or a cam mechanism, for example, and is temporarily raised upward at the time that the moving belt 522 completes one half circle. As a result, the magnetic force which has attracted the staple is weakened above the receiving box 505. The staples becomes liable to fall down into the receiving box 505 because of this weakened magnetic force coupled with the separation of the staple S caused by the blade 506. The timing for raising the movable part 521*b* does not need to be limited to the completion of one half circle of the moving belt 522 but may be set at the completion of one full circle instead. Otherwise, the time at which the revolution of the moving belt 522 required for the staple S removed at the farthest position from the receiving box 505 in the direction of width of document sheets to reach a point directly above the receiving box 505 is completed may be utilized as the timing in question.

This recovering device 500*a*, like the recovering device 500 mentioned above, is caused to assume the upper position while the removing device 400 is in the process of extracting the staple S from the bundle D of document sheets and, after the removal of the staple has been completed, is lowered to the position at which the recovering device 500*a* wholly contacts the bundle D of document sheets as illustrated in FIG. 9. As a result, the staple S is attracted by the permanent magnet 521 disposed on the inner side of the moving belt 522. At this time, the movable part 521*b* of the permanent magnet assumes a state lowered enough to contact the moving belt 522.

Thereafter, the recovering device 500*a* moves upward and, at the same time, sets the moving belt 522 revolving. As a result, the staple S which is being attracted by the permanent magnet 521 is moved in the direction of the receiving box 505 in concert with the motion of the moving belt 522. Then, at the time that the moving belt 522 completes one half circle, the movable part 521*b* of the permanent magnet moves upward. Then, the magnetic force acting on the staple S is weakened and the staple S which has reached a point directly below the movable part 521*b* falls down into the receiving box 505 and recovered.

Thus, the recovering device 500*a*, owing to the provision of the permanent magnet on the inside of the moving belt 522, is enabled to attract the staple S with stronger magnetic force than when the belt itself is formed of a magnetic body as in the recovering device 500 mentioned above. Further, the permanent magnet is adapted to be movable directly above the receiving box 505. As a result, the magnetic force which has been acting on the staple S in motion en route to the; point above the receiving box 505 is weakened directly above the receiving box 505, with the result that the staple S will be infallibly dropped down into the receiving box 505.

Example 2 of Modification of the Recovering Device

Figure 12:
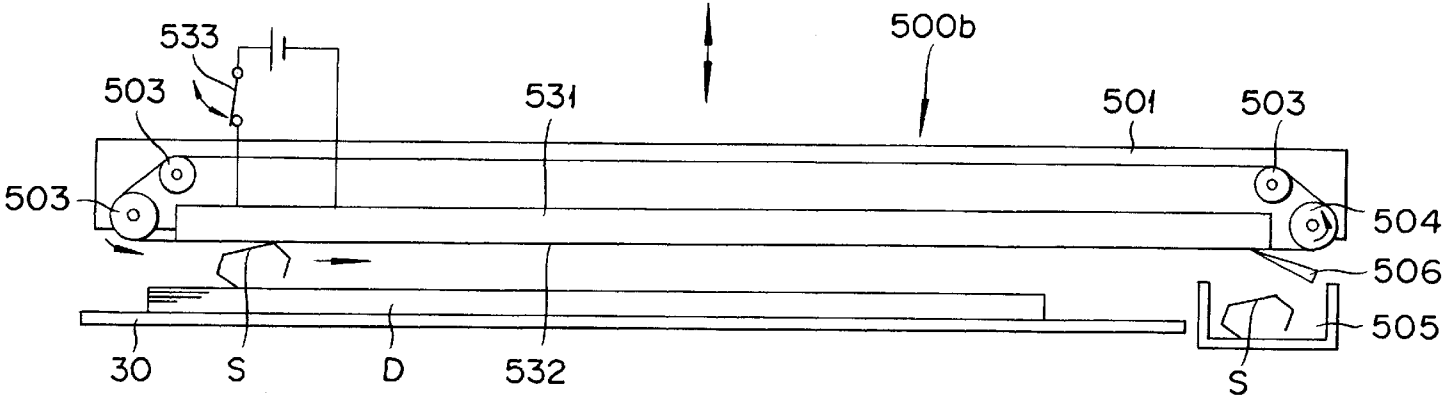
FIG. 12 is a schematic structural diagram illustrating example 2 of modification of the covering device for the binding member removing apparatus.

Now, example 2 of modification of the recovering device will be described below. This recovering device 500*b*, as illustrated in FIG. 12, is identical in basic structure with the recovering device 500*a* mentioned above. Specifically, a moving belt 532 is suspended in an endless state as passed around the supporting roller 503 and the driving roller 504 which are provided in the case 501 and the receiving box 505 and the blade 506 are disposed in the proximity of the end part on the right side in the bearings of the diagram.

The recovering device 500*b* differs from the recovering device 500*a* mentioned above in respect that an electromagnet 531 is disposed on the inner side of the moving belt.

The electromagnet 531 on the inside of the moving belt has a size so large as to cover the whole width of document sheets and reach the point above the receiving box 505. This electromagnet 531 is so adapted as to turn off a switch 533 feeding electric power for the electromagnet 531 to generate magnetic force at the time that the moving belt 522 completes one half circle or one full circle, with the result that the magnetic force which has been attracting the staple S will cease to exist. Consequently, the staple S which has been moved by the moving belt 532 to the point above the receiving box 505 is allowed to fall down into the receiving box 505 in consequence of the fact that the magnetic force of the electromagnet 531 has ceased to exist. The blade 506 is additionally provided. Here, the blade 506 performs not only the function of separating the staple S from the moving belt 531 but also the function of preventing the staple S from advancing past the receiving box 505 in consequence of the continued revolution of the moving belt 532 till the switch 533 of the electromagnet is turned off.

This recovering device 500*b*, like the recovering device 500 mentioned above, first assumes the upper position during the extraction of the staple S from the bundle D of document sheets and, after the removal of the staple, falls to the position at which the recovering device 500*b* wholly contacts the bundle D of document sheets in the same manner as illustrated in FIG. 9. At this time, the switch 533 assumes its ON position, with the result that the electromagnet 531 provided on the inside of the moving belt 532 attracts the staple S.

Thereafter, the recovering device 500*b* moves upward and, at the same time, sets the moving belt 532 revolving. As a result, the staple S which is being attracted by the permanent magnet 531 is moved in the direction of the receiving box 505 in concert with the motion of the moving belt 532. Then, at the time that the moving belt 522 completes one half circle, the switch 533 is turned off to discontinue supply of electric power to the electromagnet 531 and null the magnetic force acting on the staple S. As a result, the staple S is dropped down into the receiving box 505 and recovered.

Thus, the recovering device 500*b*, owing to the provision of the electromagnet 531 on the inside of the moving belt 532, is easily enabled to attract the staple S with strong magnetic force. Further, by controlling the supply of electric force to the electromagnet 531 with the switch 533, the staple S attracted by the magnetic force can be easily dropped down into the receiving box 505 and recovered.

Example 3 of Modification of the Recovering Device

Figure 13:
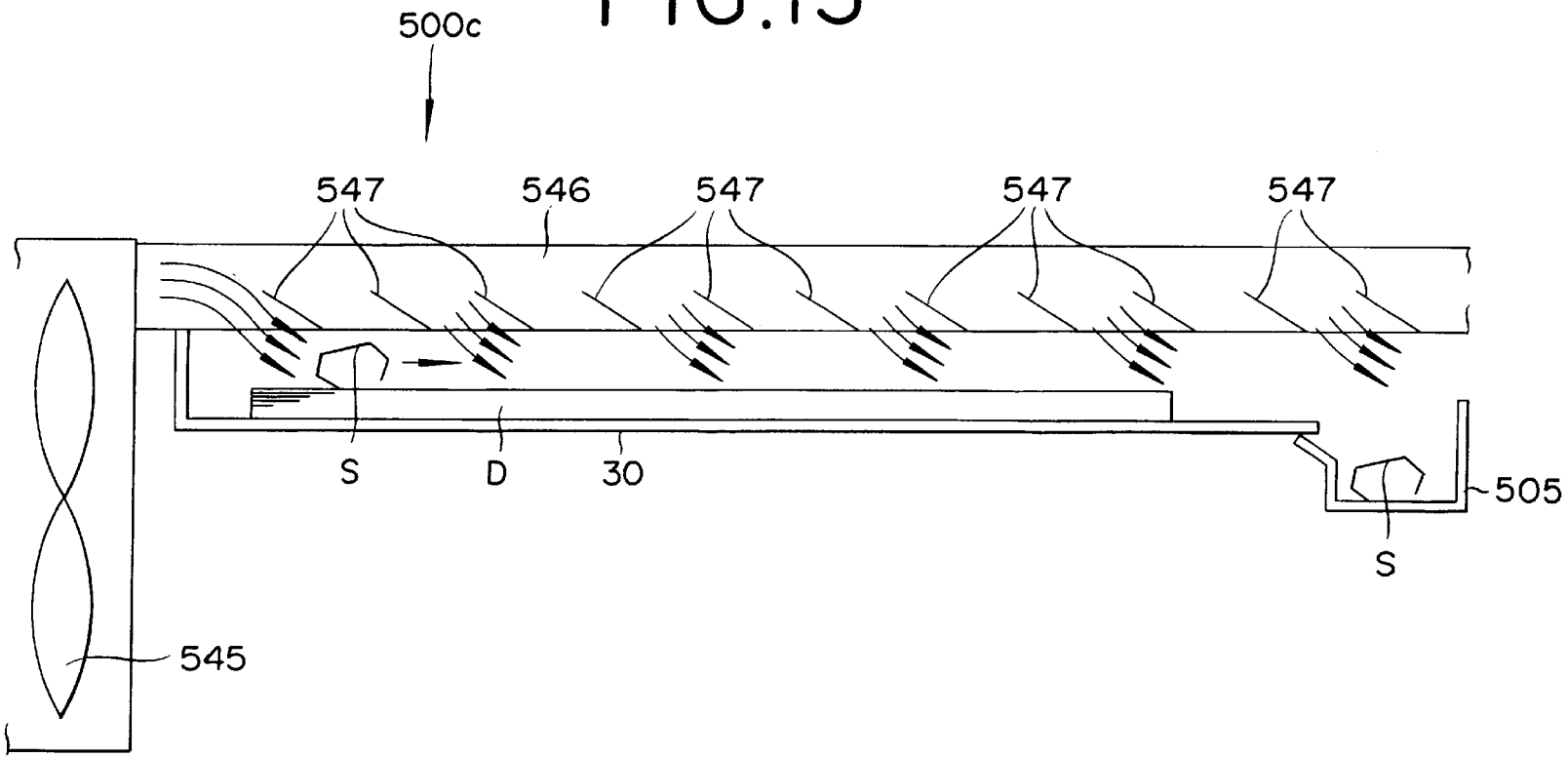
FIG. 13 is a schematic structural diagram illustrating example 3 of modification of the covering device for the binding member removing apparatus.

Now, example 3 of modification of the recovering device will be described below. The moving unit of this recovering device 500*c* is intended to move the staple away from the proximity of the bundle of document sheets by means of wind force. This moving unit, as illustrated in FIG. 13, is provided with a fan 545 for generating the wind force and a duct 546 for blowing the wind from the fan 545 in the fixed direction of the upper part of the bundle of document sheets. The duct 546 is provided substantially uniformly on the whole face thereof in the direction of width of the bundle D of document sheets with a plurality of wind direction controlling vanes 547 laid parallelly in one fixed direction.

The wind generated by the fan 545 flows on the bundle D of document sheets in a fixed direction (the direction of the receiving box 505 herein) with a substantially fixed wind force. As a result, the staple S which has been extracted from the bundle D of document sheets is moved toward the receiving box 505. Since this recovering device 500*c* is provided with the plurality of wind direction controlling vanes 547 and consequently enabled to apply a substantially uniform wind force at any place in the direction of width on the bundle D of document sheets, the staple S can be moved invariably and recovered infallibly in the receiving box 505, no matter whether the staple S has been removed in the end part or in the central part of the bundle D of document sheets. Owing to the utilization of the wind force, the staple can be perfectly taken away from the proximity of the bundle of document sheets without reference to the material for the staple. Thus, the staple made of copper or aluminum can be handled similarly effectively.

Example 4 of Modification of the Recovering Device

Figure 14:
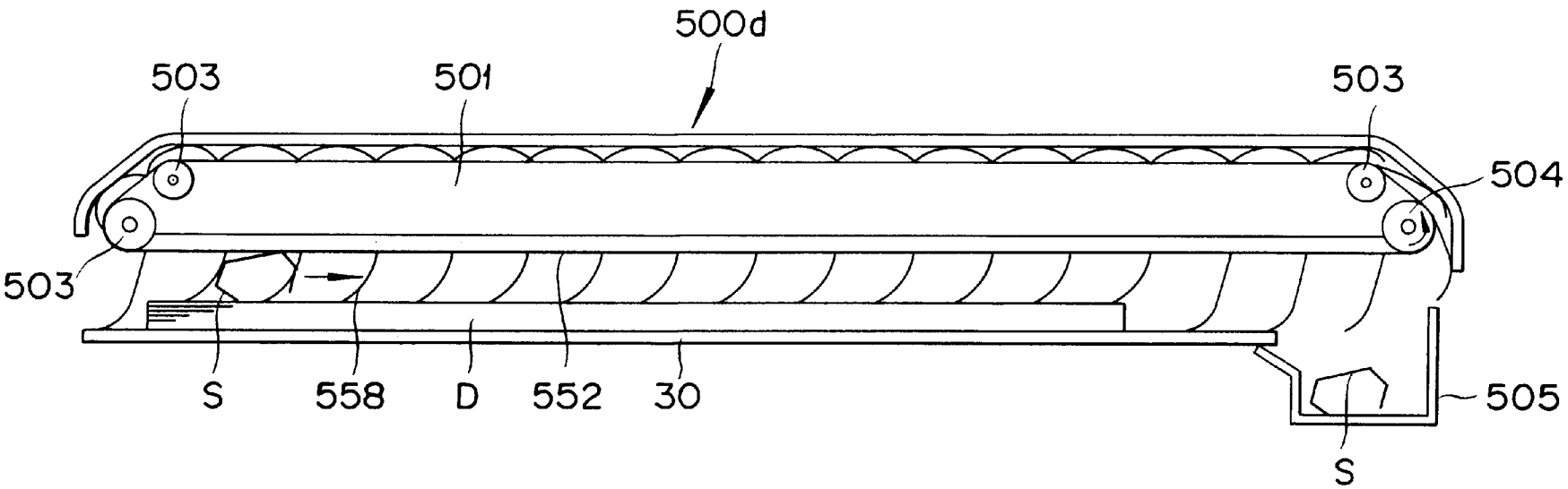
FIG. 14 is a schematic structural diagram illustrating example 4 of modification of the covering device for the binding member removing apparatus.

Now, example 4 of modification of the recovering device will be described below. The moving unit of this recovering device 500*d* is intended to move the staple away from the proximity of the bundle of document sheets by a brush provided on the moving belt. This moving unit, as illustrated in FIG. 14, is provided with an endless moving belt 552 passed around the supporting roller 503 and the driving roller 504 and a brush 558 formed on the whole surface thereof. In consequence of the revolution of the moving belt 552, therefore, the staple S extracted from the bundle D of document sheets is moved by the brush 558 as far as the receiving box 505 and recovered.

The recovering device has a simple structure owing to the fact that the recovery of the staple relies on the motion of the brush 558 as described above. The staple can be perfectly taken away from the proximity of the bundle of document sheets without reference to the material for the staple. Thus, the staple made of copper or aluminum can be handled similarly effectively.

<<Control System>>

The controller for effecting control of the removing device and the recovering device mentioned above will be described below.

Figure 15:
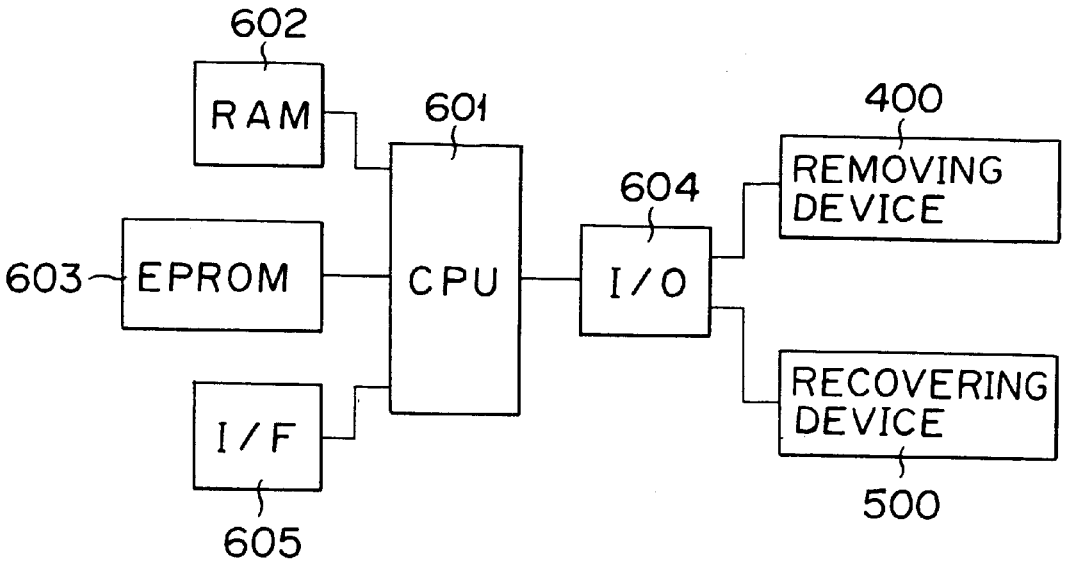
FIG. 15 is a schematic block diagram illustrating a control system for the binding member removing apparatus.

The controller has a CPU as the center thereof and, as illustrated in FIG. 15, comprises a CPU 601 for executing a processing for the control, a RAM 602 to be used in developing data which the CPU 601 requires for the processing, an EPROM 603 storing prescribed programs to be executed by the CPU 601, an I/O port 604 for transmitting necessary control signals to the relevant parts of the removing device 400 and the recovering device 500 mentioned above, and an interface (I/F) 605 for delivery of signals between the CPU 601 and a controller (not shown) of the copying machine proper 10.

Here, the CPU 601 is intended to control each device by executing a prescribed program produced by following the operating procedure which will be described more specifically hereinbelow. Further, this CPU 601 is situated in the ADF and operated not only to control the binding member removing apparatus but also to control the whole ADF.

<<Operation of Binding Member Removing Apparatus>>

Now, the operation of the binding member removing apparatus described above will be explained below.

Figure 17:
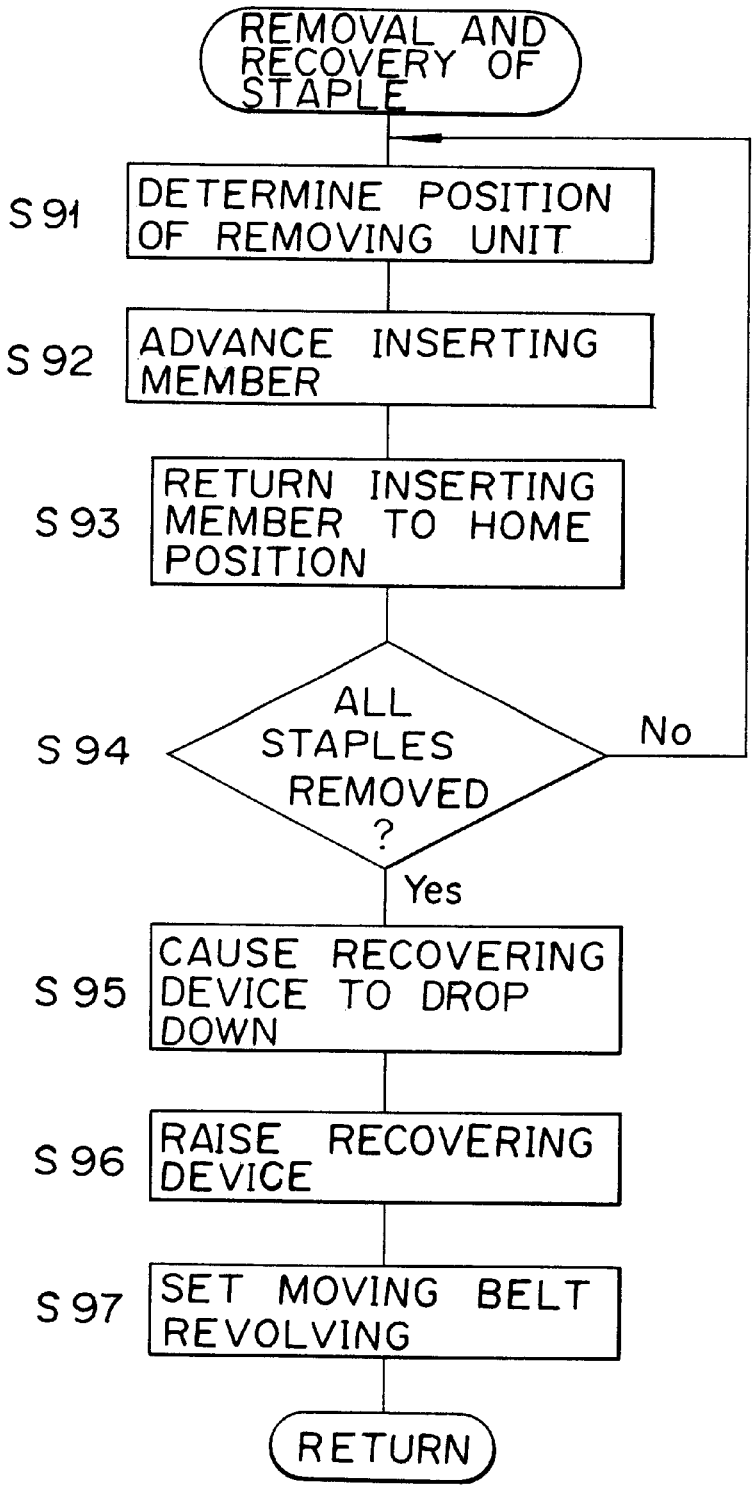
FIG. 17 is a flow chart of a subroutine illustrating the procedure of the operation for removal and recovery of a staple.

FIG. 16 and FIG. 17 are flow charts showing the operating procedures of this binding member removing apparatus.

When the bundle D of document sheets bound with a staple is set on the tray 30 of the ADF 20 and the user turns on the key for starting the copying operation on the operating panel (not shown) of the copying machine proper 10, the sensor (not shown) detects the bundle D of document sheets mounted on the tray 30 (S1). At this time, the recovering device 500 mentioned above is positioned at an upper level separated from the bundle D of document sheets. When no bundle D of document sheets is detected here, an error sign indicating the absence of detection is displayed (S11) and the processing is terminated.

When the bundle D of document sheets is detected, various variables necessary for the processing are set (S2) as an initial setting. Here, the retry variable R which will be described herein below will be cleared, for example.

Subsequently, the removing unit moving mechanism 440 and the supporting member moving mechanism 450 of the removing device 400 mentioned above set the removing unit 410 moving and the detecting device 470 detecting the staple S (S3). Here, the direction in which the bundle D of document sheets is mounted on the tray 30 is so restricted that the edge of the bundle D bound with the staple S is positioned on the upstream side in the direction of conveyance of document sheets. In this case, the detection of the staple S is effected in a prescribed area in the proximity of the leading end of the bundle D of document sheets in the direction of conveyance. Incidentally, when the direction in which the bundle D of document sheets is mounted on the dray 30 is so restricted that the edge of the bundle D of document sheets bound with the staple S is positioned in the end part on the upstream side in the direction of conveyance of document sheets or in one end part in the direction of width of document sheets, the detection of the staple S is effected in an L-shaped prescribed area in the proximity of the leading end on the upstream side in the direction of conveyance of document sheets and the proximity of the end part in the direction of width of document sheets. Preferably in this case, the inserting member 411 is so disposed that the leading end thereof is slanted by about 450 toward the left relative to the downstream side in the direction of conveyance in the bearings of FIG. 3 (incidentally, it is depicted in this disposition in FIG. 4–FIG. 7). In this manner, the ideal operation of the inserting member 411 is secured without reference to the direction of the needles of the staple S after the bundle D of document sheets has been bound. Naturally, it is permissible to construct the inserting member 411 so as to allow change of direction, though with more or less complication of structure.

When the detecting device 470 has detected the staple S (S4), the retry variable R is examined to determine whether or not it has exceeded 3 (S5). This retry variable R is intended to take count of the number of rounds of the operation performed for removing the staple S which will be described specifically herein after.

When the retry variable R is not found to exceed 3, the position of the staple S detected beforehand by the detecting device 470 is stored in the memory (S6).

Then, the removal unit 410 is examined to determine whether or not it is at the end position, namely whether or not the removing unit 410 has completed its motion wholly in the direction of width and the direction of length of document sheets (S7). Incidentally, when the electric motor 445 for driving the removing unit moving mechanism 440 and the supporting member moving mechanism 450 as described above and the motor 456 fitted with an encoder are used, the detection of the end position is effected by the output of the encoder taking count of the number of the rotations of the motor.

When the judgment at the step S7 is that the removing unit 410 has not reached the end position, the processing returns to the step S4 and the operation for detecting the staple S is continued. While the operation of detecting the staple S is in process, the removing unit 410 moves incessantly up to the end position and meanwhile detects the staple S. When a plurality of staples S are detected in this while, the positions of these staples so detected are memorized sequentially (in this case, the positions of the plurality of staples S are memorized).

When the judgment at the step S7 is that the removing unit 410 has reached the end position, the removing unit is stopped (S8) and the processing is subsequently shifted to the operation for the removal and recovery of the staple S (S9).

The operation for the removal and recovery of the staple is carried out as illustrated in FIG. 17. First, the removing unit 410 is moved to the memorized position of the staple S and the inserting member 411 is so positioned that the leading end thereof faces in the direction of the staple S (S91).

Subsequently, the electric motor 415 is set rotating and the inserting member 411 is moved in the direction of the staple S (S92). As a result, the inserting member 411 is easily passed between the bundle D of document sheets and the staple S because the elongated parts 412 of the inserting member 411 have their thicknesses in the direction of thickness of the bundle of document sheets decrease toward the leading ends thereof. Since the staple S is gradually separated from the bundle D of document sheets in consequence of the advance of the inserting member 411, the staple S can be smoothly removed and the possible infliction of damage on the bundle D of document sheets can be prevented. In this case, the proximity of the leading end of the bundle D of document sheets is raised in advance to a prescribed height by an elevating member (not shown) to align the inserting member 411 and the staple S in the direction of height. Optionally, this alignment of the positions in the direction of height may be effected by lowering the inserting member 411 by a prescribed distance. As a result, the staple S is extracted and removed from the bundle D of document sheets as illustrated in FIG. 4B.

Subsequently, the electric motor 415 is rotated reversely to move the inserting member 411 backward to the home position (S93).

Then, the bundle D of document sheets is examined to determine whether or not all the staples required to be removed have disappeared (S94). The processing is shifted to the subsequent step S95 when the judgment is that the staples to be removed are absent. When the bundle D of document sheets is found to entrain any staple yet to be removed, the processing is returned to the step S91. All the remaining staples S are removed by repeating the steps S91–S94. Here, the judgment whether or not all the staples to be removed have disappeared is made based on the memory of staple positions. Specifically, the staple positions detected are memorized as in the RAM and they are sequentially erased apiece after each operation for the removal of a staple. When any staple position remains in the memory, it is judged that the removal of staple is not complete.

After the removal of staple has been completed, the recovering device 500 mentioned above is moved downward till it substantially contacts the bundle D of document sheets (S95). As a result, the moving belt 502 utilizes the magnetic force thereof to attract the staple S which has been removed from the bundle D of document sheets.

Subsequently, the recovering device 500 is moved upward (S96) and the moving belt 502 is moved rotationally (S97). As a result, the staple S is moved as far as the receiving box 505, removed from the proximity of the document sheets, and recovered in the receiving box 505. In this while, the removing unit 410 is moved to the home position (the left end in the direction of width of document sheets relative to the direction of conveyance as illustrated in FIG. 3).

Since the operation for removal and recovery of the staple S is completed as a result, the processing is returned to the main routine illustrated in FIG. 16. As the operation for removal and recovery of the staple S has been completed, the retry variable R is increased by 1 (S10) and the processing is returned to the step S3.

Then, the removing unit 410 is again moved to perform the operation for detecting the staple S (S3–S7). Here, no detection of a staple S will occur when the staple S has been extracted normally from the bundle D of document sheets by the preceding operation for removal and recovery of staple. When no staple S is detected at the step S4, therefore, this operation for detection of a staple S is continued till the removing unit 410 subsequently reaches the end position.

When the removing unit 410 reaches the end position (S12) because of the absence of a staple S from the bundle D of document sheets, the operation for conveyance of document sheets is started (S13) and the present operation for removal of the staple is completed.

Thereafter, the ADF 20 conveys document sheets one by one from the bundle D of document sheets onto the platen glass of the copying machine proper 10. Subsequently, the copying machine proper 10 reads the image on each document sheet and issues a produced copy.

When the detecting device 470 again detects a staple S, namely when the preceding operation for removal and recovery of a staple S (S9) fails to remove the staple S, at the step S4, the operation for removal and recovery of the staple S is retried by performing a processing including the work of detecting a staple at the steps S3–S7 and the work of removing and recovering the staple S at the steps of S8–S10 till the retry variable R at the step S5 surpasses 3. In the present example, therefore, the operation for removal and recovery of the staple is performed up to three repetitions including the first operation when the removal of the staple S ends in failure.

When the three cycles of the operation for removal and recovery of the staple S fail to remove the staple S, namely when the retry variable R at the step S5 surpasses 3, a verdict that the removal of the staple S entails a certain problem is issued and a display purporting that the removal of the staple S is impossible is put up (S14) and the whole processing including the operation of the copying machine proper 10 is completed.

Even when the processing described above fails to remove the staple S, the retry is carried out up to three repetitions including the first operation for removal and recovery. When the detection of the staple S by the detecting device 470 ceases to occur as a result, the conveyance of document sheets is executed with a verdict that the staple S has been normally removed and recovered. When the detection of a staple S by the detecting device 470 continues to occur even after three cycles of the operation for removal and recovery, the processing is completed and the operation for conveyance of document sheets is prevented from being executed. If the staple S is not removed in spite of this measure, the continuance of the operation for conveyance of document sheets will be avoided. In this case, therefore, such inconveniences as damaging document sheets and suffering document sheets to tear partly, enter the path of conveyance, and block it eventually are prevented from occurring.

In the first example described above, such principal components of the binding member removing device as the detecting device, removing device, and recovering device are installed in the removing unit 410 and the removing unit 410 is moved to effect detection, removal, and recovery of the staple. Since the bundle of document sheets itself which is bound by the staple is only required to be set on the tray 30, therefore, and not required to be moved for the sake of removal of the staple, the ADF is allowed to be constructed compactly as a device.

In the first example mentioned above, the inserting member 411 as depicted above is constructed as to be passed between the bundle of document sheets and the staple toward the downstream side in the direction of conveyance of document sheets. Optionally, the inserting member 411 may be so constructed as to be passed between the bundle of document sheets and the staple toward the upstream side in the direction of conveyance of document sheets. Further, in the first example mentioned above, the direction in which the bundle D of document sheets is set on the tray as described above is so restricted that the edge of the bundle D of document sheets bound by the staple S is positioned on the downstream side in the direction of conveyance of document sheets. The direction in question may be alternatively so restricted that the edge is positioned on the end part side in the direction of width of document sheets. In this case, inserting member 411 may be so constructed as to produce a forward-rearward motion in the direction of width of document sheets.

In the first example mentioned above, the inserting member 411 may be formed in a width large enough to cover the whole width of document sheets. In this case, the inserting member 411 is fated to have formed throughout the entire width of document sheets a plurality of elongated parts 412 arranged after the fashion of teeth of a comb. When the direction in which the bundle D of document sheets is set on the tray is so restricted that the edge of the bundle D of document sheets bound by the staple S is positioned on the downstream side in the direction of conveyance of document sheets, for example, the inserting member 411 may be so constructed as to be moved in such a manner as to scrape the entire surface of a prescribed area in the proximity of the leading end on the downstream side in the direction of conveyance of document sheets. In this construction, the detecting device 470 for detecting the staple S, the removing unit moving mechanism 440, and the supporting member moving mechanism 450 may be omitted.

SECOND EXAMPLE

The second example is a copying machine which is provided with an automatic document feeder incorporating therein a binding member removing apparatus according to the present invention.

This copying machine, similarly to what is described with reference to FIG. 1 in the first example mentioned above, is provided on the copying machine proper 10 with the automatic document feeder (ADF) 20. Here, the construction and operation of the copying machine proper 10 are omitted as well known from the following description.

<<Automatic Document Feeder>>

Figure 18:
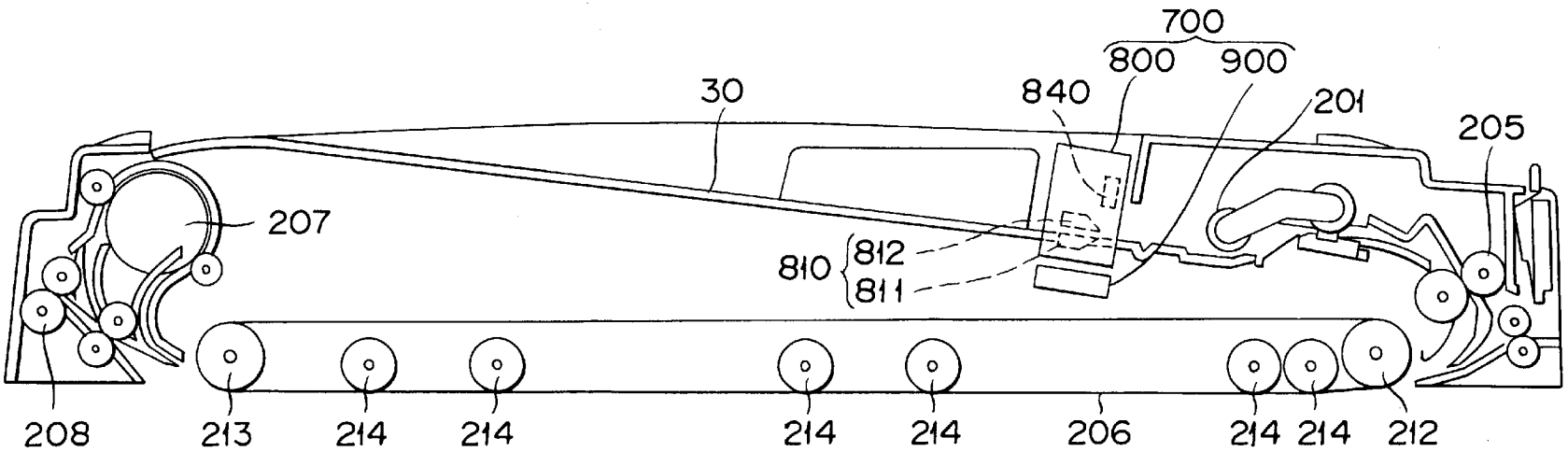
FIG. 18 is a schematic structural diagram illustrating the internal construction of an automatic document feeder.

FIG. 18 is a structural diagram illustrating schematically the internal construction of the automatic document feeder (ADF).

The ADF 20, as illustrated in FIG. 18, is provided with the tray 30 for mounting thereon the bundle of the document sheets as a bundle of sheets of paper, the separating roller 201 for extracting the document sheets one by one, the resist roller pair 205 and the conveying belt 206 for conveying the separated document sheets, the inverting roller 207 for inverting the obverse-reverse face of the document sheet, and the discharge roller pair 208 for discharging the document sheet. The document sheet which has departed from the discharge roller pair 208 is discharged into the discharged paper tray 209 (FIG. 1 refers). The conveying belt 206 is stretched in an endless state between the driving roller 212 and the following roller 213 so as to cover the entire surface of the platen glass of the copying machine proper 10. Inside the conveying belt 206, a multiplicity of backup rollers 214 are rotatably disposed so as to press the conveying belt 206 against the platen glass.

<<Binding Member Removing Device>>

The ADF 20 mentioned above incorporates therein a binding member removing apparatus 700 which removes a staple from a bundle of document sheets while the bundle of document sheets bound with the staple as a binding member is set on the tray 30. This binding member removing apparatus 700 is provided with a removing device 800 for removing the staple as the binding member from the bundle of document sheets and a receiving box 900 for recovering the removed staple. The binding member removing apparatus 700 is disposed in the proximity of the document sheets setting face of the tray 30 for mounting the bundle of document sheets thereon such as, for example, the proximity of the leading end part on the downstream side in the direction of conveyance of document sheets. As a result, the ADF assumes a compact structure as a whole and permits easy maintenance without requiring to give any large alteration to the layout of such components as, for example, the paper conveying mechanism.

Figure 19:
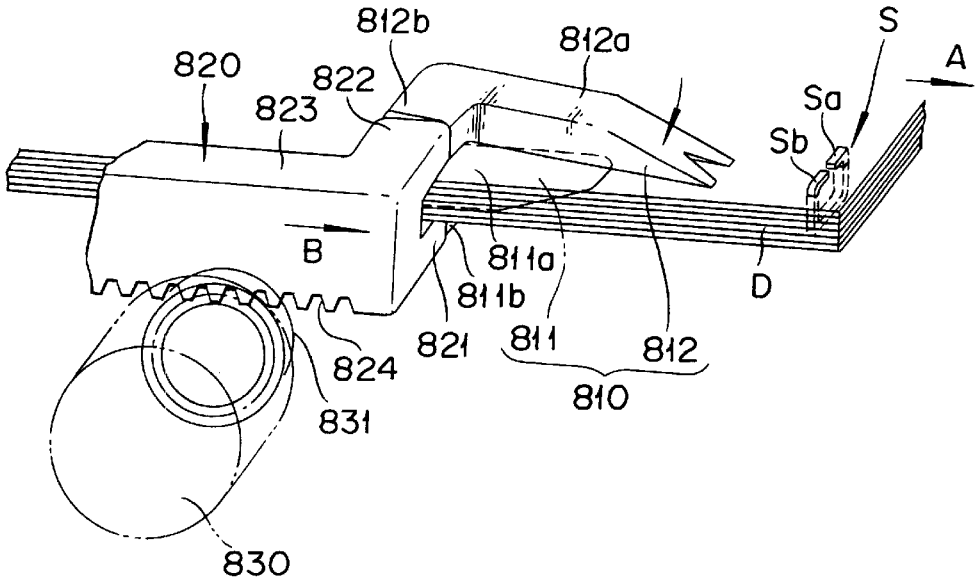
FIG. 19 is a perspective view illustrating a bundle of sheets of paper bound with a staple and the essential part of the binding member removing apparatus.

FIG. 19 is a perspective view illustrating the bundle of document sheets bound with the staple S and the essential part of the removing device 800 of the binding member removing apparatus 700.

The staple S, as illustrated in FIG. 19, is shaped like a needle provided with opposite pointed ends and adapted to bind the bundle D of document sheets by passing the opposite shank parts Sa, Sb thereof through the bundle D of document sheets until they emerge from the rear face side of the bundle and folding the emerging shank parts inward toward each other.

The removing device 800 is provided with inserting means 810 to be passed between the bundle D of document sheets and the staple S binding the bundle D of document sheets and a supporting member 820 supporting the inserting means 810 and enjoying movability in the direction of conveyance of document sheets indicated by an arrow mark A. Particularly in this example, the inserting means 810 is provided with a first inserting member to be passed between one face of the bundle D of document sheets and the staple S and a second inserting member 812 to be passed between the other face of the bundle D of document sheets and the staple S. In the first and second inserting members 811 and 812, the second inserting member 812 is disposed on the reverse face side of the obverse and reverse sides of the bundle D of document sheets, namely the face of the side on which the opposite shank parts Sa, Sb of the staple S are positioned and the first inserting member 811 is disposed on the obverse face side, namely the face of the side on which the opposite shank parts Sa, Sb are not positioned. The removing device 800 is further provided with a drive mechanism for moving the first and second inserting members 811, 812 respectively toward the interface between the bundle D of document sheets and the staple S. The drive mechanism, from the viewpoint of compaction, embraces an electric actuator, specifically an electric motor 830 herein.

The first inserting member 811 is substantially shaped like the letter L comprising an elongated part 811*a* extending in the direction of insertion into the staple S indicated by an arrow mark B and a basal end part 811*b* extending in the direction perpendicular to the direction of insertion B mentioned above. The basal end part 811*b* is connected to the rear end part of the elongated part 811*a* along the direction of insertion B. The elongated part 811*a* is formed in a sloped shape so that the thickness thereof in the direction of thickness of the bundle of document sheets decreases toward the leading end thereof. The leading end of the elongated part 811*a* is formed in an arcuate shape.

The second inserting member 812 likewise is substantially shaped like the letter L comprising an elongated part 812*a* and a basal end part 812*b*. The basal end part 812*b* is connected to the rear end part of the elongated part 812*a* in the direction of insertion B. The elongated part 812*a* is formed in a sloped shape so that the thickness thereof in the direction of thickness of the bundle of document sheets decreases toward, the leading end thereof. The leading, end of the elongated part 812*a*, unlike that of the first inserting member 811, is shaped like a forked claw. Owing to this shape of a forked claw, the second inserting member 812 is infallibly passed between the opposite folded shank parts Sa, Sb of the staple S and the rear side of the bundle D of document sheets.

The width of the leading end part of each of the inserting members 811 and 812 is set to equal the size between the shank parts Sa, Sb of the staple S to be used.

Incidentally, the inserting members 811 and 812 may be made of an aluminum alloy, for example, from the viewpoint of decreasing weight. They do not need to be limited to this particular material. They may be otherwise made of resinous materials and ceramic materials besides various metallic materials. The surfaces thereof, for the purpose of decreasing the frictional resistance thereof, may be coated with fluorine resin.

The supporting member 820 is provided with a vertically paired supporting arms 821 and 822 which are provided in a main body part 823 astride the lateral end edge of the bundle D of document sheets parallel to the direction A of conveyance of document sheets. The supporting arms 821 and 822 are elongated in the direction perpendicular to the direction A of conveyance of document sheets, namely the direction of width of document sheets. A basal end part 811*b* of the first inserting member 811 is rotatably attached to the leading end part of the supporting arm 821 on the lower side in the diagram and a basal end part 812*b* of the second inserting member 812 is rotatably attached to the leading end part of the supporting arm 822 on the upper side of the diagram.

The supporting member 820 is provided with a spring (not shown) for generating an elastic force capable of rotating the inserting members 811 and 812 in directions allowing the leading ends of the elongated parts 811*a* and 812*a* to approximate each other. By the action of this spring, the leading ends of the inserting members 811 and 812 collide against the bundle D of document sheets and infallibly pass between the bundle D and the staple S even when the thickness of the bundle D of document sheets varies. When the bundle D of document sheets is fed into the gap between the two inserting members 811 and 812, it is set without any obstacle because the two inserting members 811 and 812 are parted from each other by overcoming the elastic force of the spring.

A rack 824 is formed on the lower face of a main body part 823 of the supporting member 820 and a pinion is meshed with the rack 824. The output shaft of the electric motor 830 is fixed on the, pinion 831. The rotary drive of the electric motor 830, therefore, is converted into a forward-rearward motion of the supporting member 820 in the direction of insertion through the medium of the pinion 831 and the rack 824 and further converted into a forward-rearward motions of the first and second inserting members 811 and 812 in the direction of insertion B. Since this example contemplates imparting the forward-rearward motion to the sole supporting member 820 which has the two inserting members 811 and 813 attached thereto, the moving mechanisms for the inserting members 811 and 812 are allowed to have a simple and compact structure. A wheel (not shown) is rotatably attached to the main body part 823 of the supporting member 820 and it is moved in the direction A of conveyance of document sheets as guided by a rail (not shown) laid on the main body side of the ADF 20.

Here, the lengths of the inserting members 811 and 812 and the positions for fixing them on the supporting member 820 are so decided that the position of the leading end of the second inserting member 812 falls on the more advanced side in the direction of insertion B than the position of the leading end of the first inserting member 811. When the electric motor 830 is driven to produce a forward-rearward motion of the supporting member 820, therefore, The second inserting member 812 disposed on the rear face side of the bundle D of document sheets is fated to be passed between the bundle D of document sheets and the staple S earlier than the first inserting member 811 disposed on the obverse face side of the bundle D of document sheets. Further, since the elongated parts 811*a* and 812*a* of the inserting members 811 and 812 each have a sloped shape, first the second inserting member 812 produces a motion of opening the opposite shank parts Sa, Sb of the staple S and then the first inserting member 811 lifts the staple S reverted to the substantial shape of U from the bundle D of document sheets and extracts it completely.

The removing device 800, as illustrated in FIG. 18, is provided with a sensor 840 for detecting the staple S in the bundle D of document sheets which is set at a stated position. This sensor 840 is a magnetic sensor capable of detecting the staple S made of a metal, for example. It can discern the presence or absence of a staple S and the position of the staple S without requiring contact from above the bundle D of document sheets. The sensor 840 does not need to be limited to the magnetic sensor. This detection may be effected by optically photographing the staple S and processing the produced photograph accordingly or by the use of a contact pressure sensor.

The receiving box 900, as illustrated in FIG. 18, is disposed inside the ADF 20 at the lower position of the removing device 800 as opposed thereto across the path for conveyance of document sheets. The staple S which has been extracted from the bundle D of document sheets by the removing device 800 is caused to fall down freely into the receiving box 900 to be recovered.

<<Controlling System>>

Figure 20:
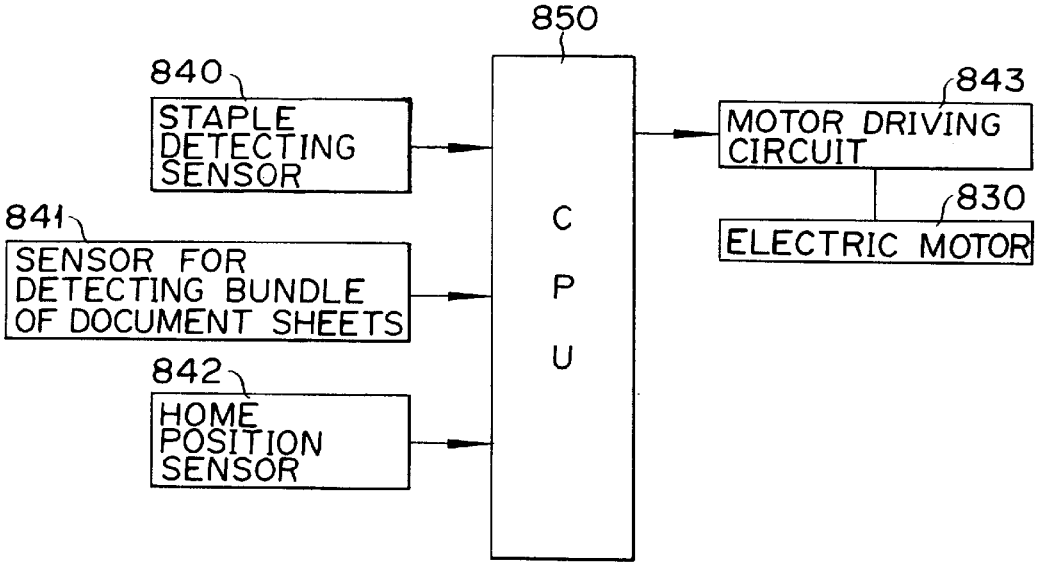
FIG. 20 is a schematic block diagram illustrating a control system for governing the control of the binding member removing apparatus.

FIG. 20 is a schematic block diagram showing the controlling system for governing the control of the binding member removing apparatus.

To a CPU 850, the sensor 840 for detecting the staple S is connected and a sensor 841 for detecting the presence or absence of the bundle D of document sheets on the tray and a home position sensor 842 for detecting the initial position of the supporting member 820 are also connected. The sensor 841 and the home position sensor 842 are each formed of a limit switch or a photo interrupter. From the CPU 850, control signals for turning on or off the drive motor 830 are issued to a motor drive circuit 843.

Figure 21:
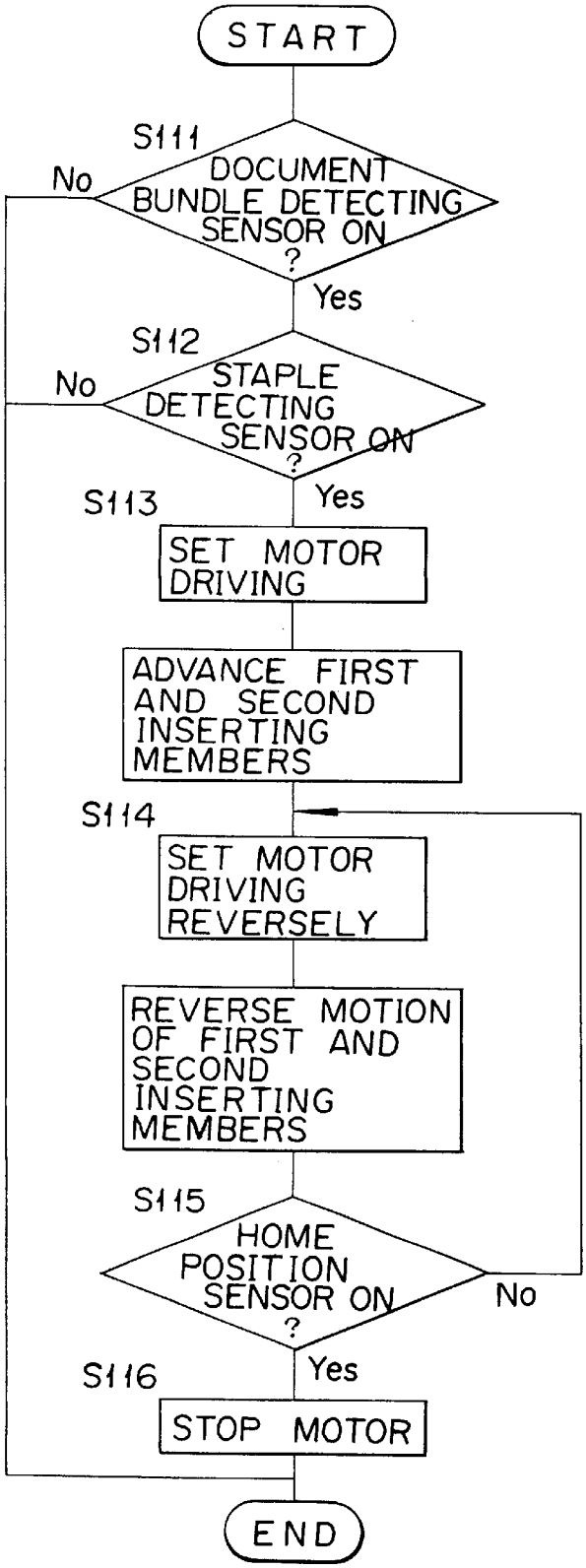
FIG. 21 is a flow chart illustrating the operation of the binding member removing apparatus.

Now, the operation of the binding member removing apparatus will be described below. FIG. 21 is a flow chart showing the operation of the binding member removing apparatus and FIG. 22A–FIG. 22G are diagrams intended to aid in the description of the operation for removal of the staple S. In these diagrams, the first inserting member 811 and the second inserting member 812 are illustrated in patterns allowing separate motion.

When the bundle D of document sheets bound with the staple S is set on the tray 30 of the ADF 20, the sensor 841 detects the bundle D of document sheets (step Sill) and the sensor.840 executes the operation for detection of the staple S (S112).

Figure 22A:
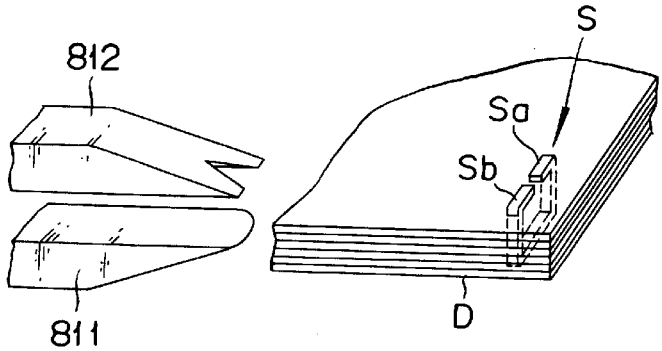
FIG. 22A–FIG. 22G are diagrams illustrating the operation for the removal of a staple.
Figure 22B:
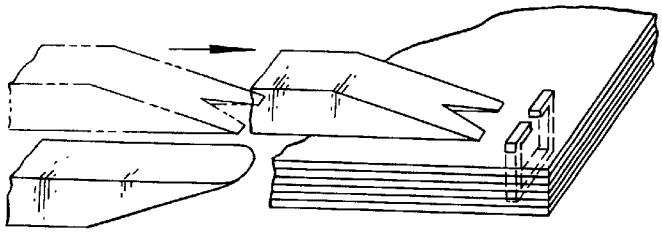
Figure 22C:
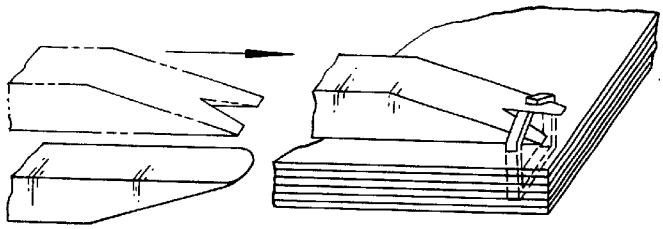
Figure 22D:
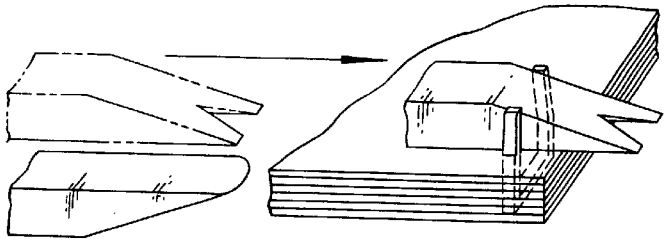

When the staple S is detected, the electric motor 830 is set rotating (S113) and the second inserting member 812 is advanced from the initial position (FIG. 22A) to the staple S. The second inserting member 812 is passed between the rear face of the bundle D of document sheets and the staple S earlier than the first inserting member 811 (FIG. 22C). Since the elongated part 812*a* of the second inserting member 812 has a sloped shape, the opposite shank parts Sa, Sb of the staple S are gradually opened in consequence of the advance of the second inserting member 812 (FIG. 22D).

Figure 22E:
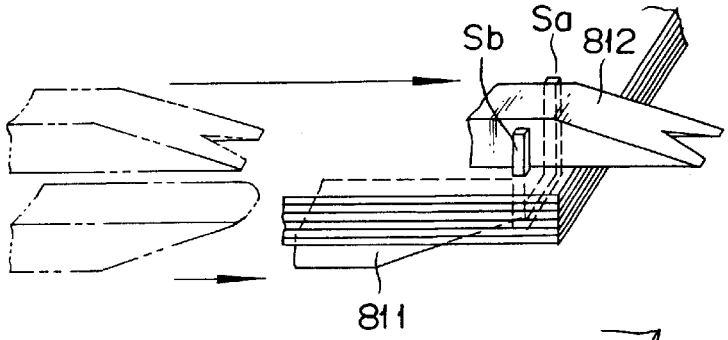
Figure 22F:
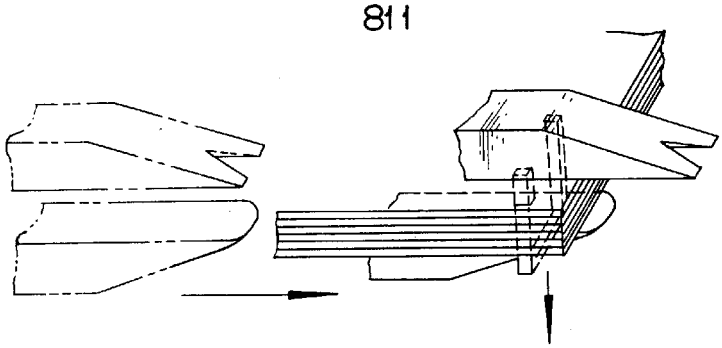

The first inserting member 811 is passed between the obverse face of the bundle d of document sheets and the staple S at nearly the same time that the operation for opening the opposite shank parts Sa, Sb of the staple by the second inserting member 812 is completed (FIG. 22E). Since the elongated part 811*a* of the first inserting member 811 also has a sloped shape, the staple S which has been reverted to the substantially U shape is gradually lifted from the bundle D of document sheets and eventually extracted in consequence of the advance of the first inserting member 811 (FIG. 22F).

Figure 22G:
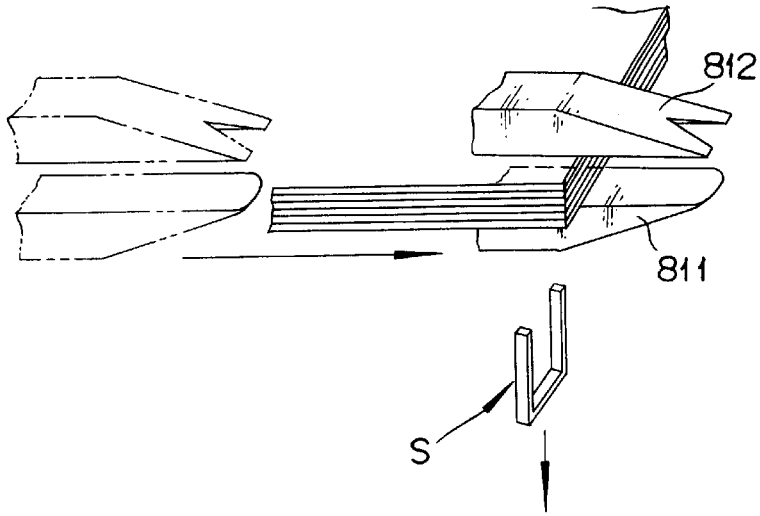

When the first inserting member 811 is moved to the position limiting the advance, the staple S is completely extracted from the bundle D of document sheets. The removed staple S is allowed to drop down freely into the receiving box 900 for recovery (FIG. 22G).

Then, the electric motor 830 is set rotating reversely (S114) and the first and second inserting members 811 and 812 are moved rearward to the respective home positions. When the home position sensor 842 is turned on, the electric motor 830 is stopped (S115 and S116). As a result, the first and second inserting members 811 and 812 are returned to the home positions (FIG. 22A) and the series of operations for removal of the staple S are completed.

When the copy start key of the main body 10 of the copying machine is subsequently depressed, the document sheets are separated one by one from the bundle D of document sheets and conveyed onto the platen glass. Thus, the bundle D of document sheets as kept bound with the staple S is set on the tray 30, the staple is removed automatically therefrom, and the document sheets are ready to be conveyed. Thereafter, the copying machine proper reads the image on each document sheet and emits a produced copy.

Since the binding member removing apparatus of this example is provided with the second inserting member 812 to be passed between the reverse face of the bundle D of document sheets and the staple S separately of the first inserting member 811 to be passed between the obverse face of the bundle D of document sheets and the staple S as described above, the staple S can be extracted with relatively small force as compared with the extraction of the staple S only from the obverse face side of the bundle D of document sheets. The electric motor 830 and the drive force transmitting mechanism for actuating the inserting members 811 and 812 are not required to be enlarged and the binding member removing apparatus is allowed to decrease size.

Moreover, since the second inserting member 812 disposed on the side on which the opposite shank parts Sa, Sb of the staple S are positioned is advanced and enabled to perform first an operation of opening the opposite shank parts Sa, Sb and then an operation of extracting the staple S earlier than the first inserting member 811 disposed on the side on which the opposite shank parts Sa, Sb are not positioned, the staple S can be removed smoothly and the damage on the individual document sheet in the bundle D of document sheets can be markedly decreased as compared with the extraction of the staple S having the opposite shank parts Sa, Sb retained in a folded manner.

This invention does not need to be limited to the examples described above but may be suitably altered.

The example as described above, for example, adopts a structure such that the inserting members 811 and 812 are advanced toward the downstream side in the direction of conveyance of document sheets. Conversely, it may adopt a structure such that the inserting members are advanced toward the upstream side in the direction A of conveyance of document sheets. It may otherwise adopt a structure such that the directions of forward-rearward motions of the inserting members 811 and 812 may be freely varied, depending on the direction of the staple S.

The drive mechanisms for moving the first and second inserting members 811 and 812 do not need to be limited to those which embrace an electric motor 830. They may be in a simple structure embracing a spring member and utilizing the elastic force thereof.

The leading end parts of the inserting members 811 and 812 may be formed each in the shape of a comb having a multiplicity of teeth separated with a stated interval and, at the same time, the whole width of each leading end part may be adjusted to the size of the largest of all staples S expected to be used. Since such a number of teeth of the multiplicity of teeth of the comb which matches the size between the opposite shank parts Sa, Sb are admitted into the staple S, a plurality of kinds of staples S having different sizes between the shank parts Sa and Sb can be removed by one inserting member. Even when the position of the inserting member deviates more or less relative to the staple, the staple S can be removed infallibly and easily because the required number of teeth are passed between the opposite shank parts Sa and Sb.

In the structure as illustrated in the diagram, the first and second inserting members 811 and 812 are attached to one supporting member 820 and moved simultaneously. The structure may be otherwise such that the first and second inserting members 811 and 812 are moved independently of each other (FIG. 22A–FIG. 22G refer). In this case, the structure may further incorporate therein a mechanism capable of moving the first and second inserting members 811 and 812 respectively in directions perpendicular to the directions of insertion B. As a result, not only the staple S which is fastened to a corner part of the bundle D of document sheets but also the staple S which is fastened at an arbitrary position in the direction of width of the bundle D of document sheets can be removed. For the purpose of moving the inserting members 811 and 812 respectively in directions perpendicular to the direction of insertion B, for example, it suffices to install a mechanism which is provided with a feed screw shaft disposed along the direction of width of document sheets and adapted to be driven rotationally and nut parts disposed in the inserting members 811 and 812 and intended to be passed by the feed screw shaft mentioned above. In the removing device for extracting a staple S which is fastened at an arbitrary position, the sensor for detecting the staple S may be so installed as to be freely moved within a prescribed range.

While there have been described preferred embodiments of the invention, it is to be understood that the invention is not limited thereto but may be variously modified by any person of ordinary skill in the art within the scope of the technical idea of the present invention.

What is claimed is:

1. A binding member removing apparatus, comprising a tray for mounting thereon a bundle of sheets of paper bound with a binding member, a removing unit for removing said binding member from said bundle of sheets of paper mounted on said tray wherein the removing unit releases the binding member after removing the binding member from said bundle of sheets of paper, and a moving unit for receiving said binding member after said removing unit releases said binding member and moving said binding member.

2. A binding member removing apparatus according to claim 1, wherein said moving unit moves the removed binding member on said bundle of sheets of paper.

3. A binding member removing apparatus according to claim 1, which further comprises a receiving part positioned in the proximity of said tray and adapted to receive said binding member conveyed by said moving unit.

4. A binding member removing apparatus according to claim 3, wherein said moving unit incorporates in the proximity of said receiving part a separating member for separating said binding member from said unit.

5. A binding member removing apparatus according to claim 4, wherein said separating member is a blade.

6. A binding member removing apparatus according to claim 1, wherein said moving unit contains a magnetic body and said binding member is moved by moving said magnetic body.

7. A binding member removing apparatus according to claim 6, wherein said magnetic body is a conveying belt endowed with magnetic power.

8. A binding member removing apparatus according to claim 1, wherein said moving unit comprises a conveying belt and a magnetic body opposed to said binding member across said conveying belt.

9. A binding member removing apparatus according to claim 8, which further comprises a receiving part for receiving said binding member conveyed by said moving unit, said magnetic body being so constructed that the magnetic force thereof is weakened in the proximity of said receiving part.

10. A binding member removing apparatus according to claim 8, wherein said magnetic body is an electromagnet.

11. A binding member removing apparatus according to claim 1, wherein said moving unit is so constructed as to be freely moved between a first position approximating closely to said tray and a second position parted from said tray.

12. A binding member removing apparatus according to claim 1, wherein said moving unit includes a fan and moves said binding member with wind force.

13. A binding member removing apparatus, comprising a tray for mounting thereon a bundle of sheets of paper bound with a binding member, a removing unit for removing said binding member from said bundle of sheets of paper mounted on said tray, and a moving unit for moving said binding member removed in said removing unit, wherein said moving unit includes a belt furnished on the surface thereof with a brush and moves said binding member by moving said belt.

14. An automatic document feeder for sequentially conveying document sheets from a bundle of document sheets, comprising a tray for mounting thereon a bundle of document sheets bound with a binding member, a removing unit for removing said binding member from said bundle of document sheets mounted on said tray wherein the removing unit releases the binding member after removing the binding member from said bundle of document sheets, and a moving unit for receiving said binding member after said removing unit releases said binding member and moving said binding member.

15. An automatic document feeder according to claim 14, wherein said moving unit moves the removed binding member on said bundle of document sheets.

16. A sheet processing apparatus for performing a prescribed processing on a sheet, comprising a tray for mounting thereon a bundle of sheets of paper bound with a binding member, a removing unit for removing said binding member from said bundle of sheets of paper mounted on said tray wherein the removing unit releases the binding member after removing the binding member from said bundle of sheets of paper, and a moving unit for receiving said binding member after said removing unit releases said binding member and moving said binding member.

17. A sheet processing apparatus according to claim 16, wherein said moving unit moves said removed binding member on said bundle of sheets of paper.

18. An image forming apparatus for forming an image on a sheet of paper, comprising a tray for mounting thereon a bundle of sheets of paper bound with a binding member, a removing unit for removing said binding member from said bundle of sheets of paper mounted on said tray wherein the removing unit releases the binding member after removing the binding member from said bundle of sheets of paper, and a moving unit for receiving said binding member after said removing unit releases said binding member and moving said binding member.

19. An image forming apparatus according to claim 18, wherein said moving unit moves said removed binding member on said bundle of sheets of paper.

* * * * *